US010039966B2

(12) United States Patent
Kohno et al.

(10) Patent No.: US 10,039,966 B2
(45) Date of Patent: Aug. 7, 2018

(54) GOLF CLUB HEAD

(71) Applicant: DUNLOP SPORTS CO. LTD., Kobe-shi, Hyogo (JP)

(72) Inventors: Daisuke Kohno, Kobe (JP); Kazuhiro Hayashi, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/279,920

(22) Filed: Sep. 29, 2016

(65) Prior Publication Data

US 2017/0113109 A1 Apr. 27, 2017

(30) Foreign Application Priority Data

Oct. 23, 2015 (JP) ..... 2015-208511

(51) Int. Cl.
*A63B 53/04* (2015.01)
*A63B 60/54* (2015.01)

(52) U.S. Cl.
CPC ..... *A63B 60/54* (2015.10); *A63B 53/047* (2013.01); *A63B 2053/042* (2013.01); *A63B 2053/0408* (2013.01); *A63B 2053/0416* (2013.01); *A63B 2053/0429* (2013.01); *A63B 2053/0433* (2013.01); *A63B 2053/0458* (2013.01); *A63B 2053/0491* (2013.01)

(58) Field of Classification Search
CPC ..... A63B 53/047
See application file for complete search history.

(56) References Cited

U.S. PATENT DOCUMENTS 7,025,693 B2 * 4/2006 Sugimoto ..... A63B 53/04 473/342
2006/0073912 A1 * 4/2006 Hsieh ..... A63B 53/04 473/350
2006/0281582 A1 * 12/2006 Sugimoto ..... A63B 53/047 473/346
2011/0256957 A1 * 10/2011 Roach ..... A63B 53/04 473/332
2012/0064995 A1 * 3/2012 Morin ..... A63B 53/047 473/349
2013/0053173 A1 * 2/2013 Motokawa ..... A63B 53/04 473/349
2015/0051013 A1 2/2015 Ueda

FOREIGN PATENT DOCUMENTS

JP 2691496 B2 12/1997

* cited by examiner

*Primary Examiner* — Michael Dennis
(74) *Attorney, Agent, or Firm* — Birch, Stewart, Kolasch & Birch, LLP

(57) ABSTRACT

A head 2 includes a head body h1 and a face plate p1 fixed to the head body h1. The face plate p1 includes a plate front surface f1 having a hitting face, a plate back surface b1 which is a surface opposite to the plate front surface f1, and a plate side surface s1. The head body h1 includes an opening part to which the face plate is disposed, and a receiving surface u1 which supports the face plate p1 from back. The plate back surface b1 includes an outer peripheral edge part 16 having a circular shape. The outer peripheral edge part 16 includes a first portion x1 which abuts on the receiving surface u1, and a second portion which does not abut on the receiving surface u1 and forms a gap gp between the second portion and the receiving surface u1.

14 Claims, 22 Drawing Sheets

GOLF CLUB HEAD

The present application claims priority on Patent Application No. 2015-208511 filed in JAPAN on Oct. 23, 2015, the entire contents of which are hereby incorporated by reference.

BACKGROUND OF THE INVENTION

Field of the Invention

The present invention relates to a golf club head.

Description of the Related Art

There has been known an iron type golf club head including a head body and a face plate attached to the head body. Japanese Patent No. 2691496 discloses a head, wherein a projection, engaged with a recess of a face body to fix the face body to a head body is formed by the plastic deformation of a part of the head body. Japanese Patent Application Laid-Open No. 2015-36052 (US2015/0051013) discloses a head including a head body and a face plate, wherein the face plate includes a circular outer edge part fixed to the head body, and a noncontact part surrounded by the outer edge part and not brought into contact with the head body, and the noncontact part includes a first thin part and a second thin part each having a thickness less than the thickness of the outer edge part.

SUMMARY OF THE INVENTION

The present inventors found that a non-conventional new structure is allowed in a head to which a face plate is attached. This new structure can exhibit an effect heterogeneous from the effect of the conventional technique.

It is an object of the present invention to provide a golf club head having a structure where a face plate is attached to a head body, and having a new effect.

A preferable golf club head includes a head body and a face plate fixed to the head body. The face plate includes a plate front surface having a hitting face, a plate back surface which is a surface opposite to the plate front surface, and a plate side surface. The head body includes an opening part to which the face plate is disposed, and a receiving surface which supports the face plate from back of the face plate. The plate back surface includes an outer peripheral edge part having a circular shape. The outer peripheral edge part includes a first portion which abuts on the receiving surface, and a second portion which does not abut on the receiving surface and forms a gap between the second portion and the receiving surface.

A peripheral length of the second portion is defined as E2 and a peripheral length of the outer peripheral edge part is defined as E1. Preferably, E2/E1 is 0.05 or greater and 0.4 or less.

Preferably, the first portion includes a center disposing part located at the same position in a toe-heel direction as a center of a figure of the plate back surface. Preferably, the second portion includes a toe disposing part located on a toe side with respect to the center of a figure, and a heel disposing part located on a heel side with respect to the center of a figure.

Preferably, the head further includes an elastic body. Preferably, the elastic body is disposed in the gap.

Preferably, a peripheral part of the plate front surface includes a level difference surface located at back of the hitting face. Preferably, the head body includes a plastic deforming part covering front of the level difference surface. The level difference surface may be provided over a whole circumference of the plate front surface. Preferably, the plastic deforming part entirely covers the level difference surface.

Preferably, a peripheral part of the plate front surface includes a level difference surface located at back of the hitting face. Preferably, the head body includes a plastic deforming part covering front of the level difference surface. Preferably, the plastic deforming part is provided in a region corresponding to the first portion. Preferably, the plastic deforming part is not provided in a region corresponding to the second portion, and the head body does not exist at front of the face plate.

Preferably, the level difference surface is provided over a whole circumference of the plate front surface. The plastic deforming part is not provided in the region corresponding to the second portion, and a groove-like part including the level difference surface as a bottom face may be formed.

The head may further include a resin member. Preferably, the groove-like part is filled with the resin member.

A peripheral part of the plate front surface may include a level difference surface located at back of the hitting face, and a non-level difference surface which is an extended surface of the hitting face. Preferably, the head body includes a plastic deforming part covering front of the level difference surface. Preferably, the non-level difference surface extends to the plate side surface.

Preferably, an adhesive layer is provided between the plate side surface and the head body.

DESCRIPTION OF THE PREFERRED EMBODIMENTS

Hereinafter, the present invention will be described in detail according to the preferred embodiments with appropriate references to the accompanying drawings.

In the present application, the following terms are defined.

[Base State]

The base state is in a state where a head is placed at a specified lie angle and real loft angle on a level surface h. In the base state, a center axis line (shaft axis line) of a shaft hole of the head is provided in a vertical plane VP1. The vertical plane VP1 is a plane perpendicular to the level surface h. In the base state, a face surface (hitting face) is inclined at a real loft angle with respect to the vertical plane VP1. The specified lie angle and real loft angle are described in, for example, a product catalog or the like.

[Toe-Heel Direction]

In the head of the base state, a direction of an intersection line between the vertical plane VP1 and the level surface h is the toe-heel direction. A toe side and a heel side used in the present application should be based on the toe-heel direction.

[Face-Back Direction]

A direction perpendicular to the toe-heel direction and parallel to the level surface h is the face-back direction. A face side and a back side used in the present application should be based on the face-back direction.

[Front-Back Direction]

A direction perpendicular to the hitting face is defined as the front-back direction. In other words, a normal direction of the hitting face is defined as the front-back direction. Front and back used in the present application should be based on the front-back direction.

[Up-and-Down Direction]

A direction perpendicular to the toe-heel direction and along the hitting face is the up-and-down direction. Above and below used in the present application should be based on the up-and-down direction.

Figure 1:
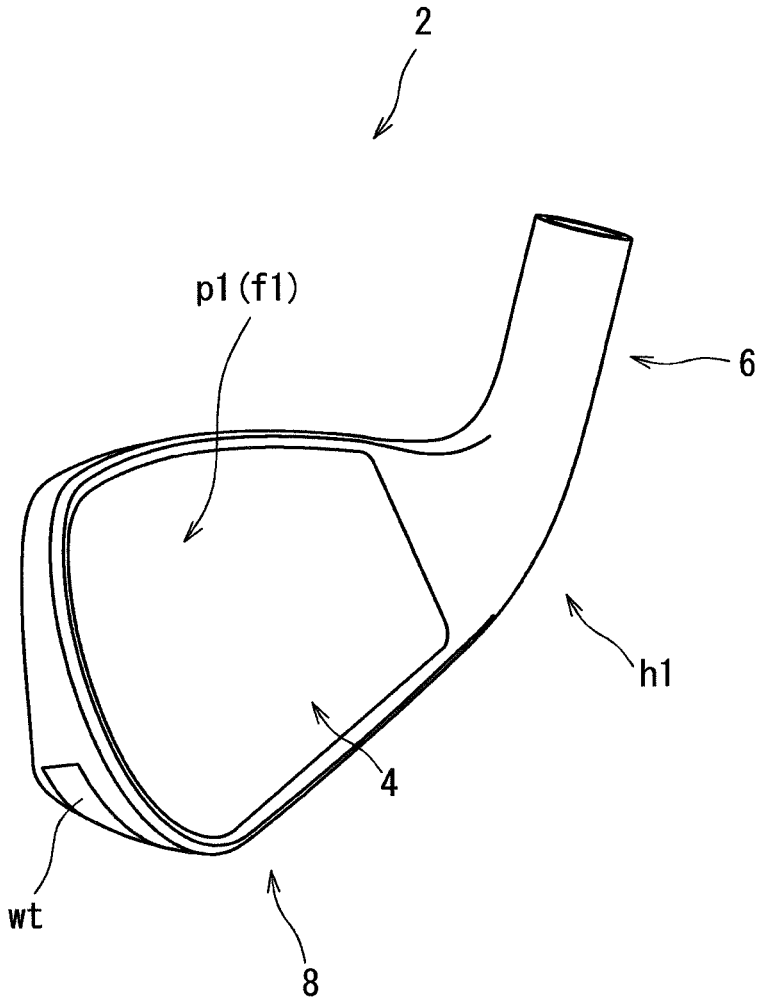
FIG. 1 is a perspective view of a golf club head of a first embodiment.
Figure 2:
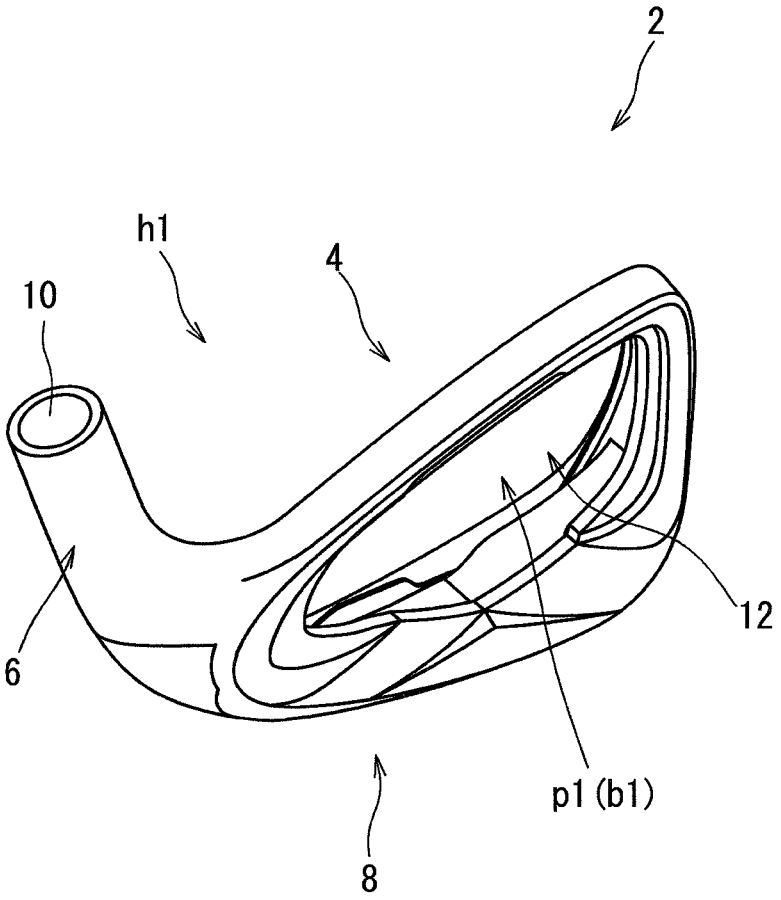
FIG. 2 is a perspective view showing the back surface of the head of FIG. 1.
Figure 3:
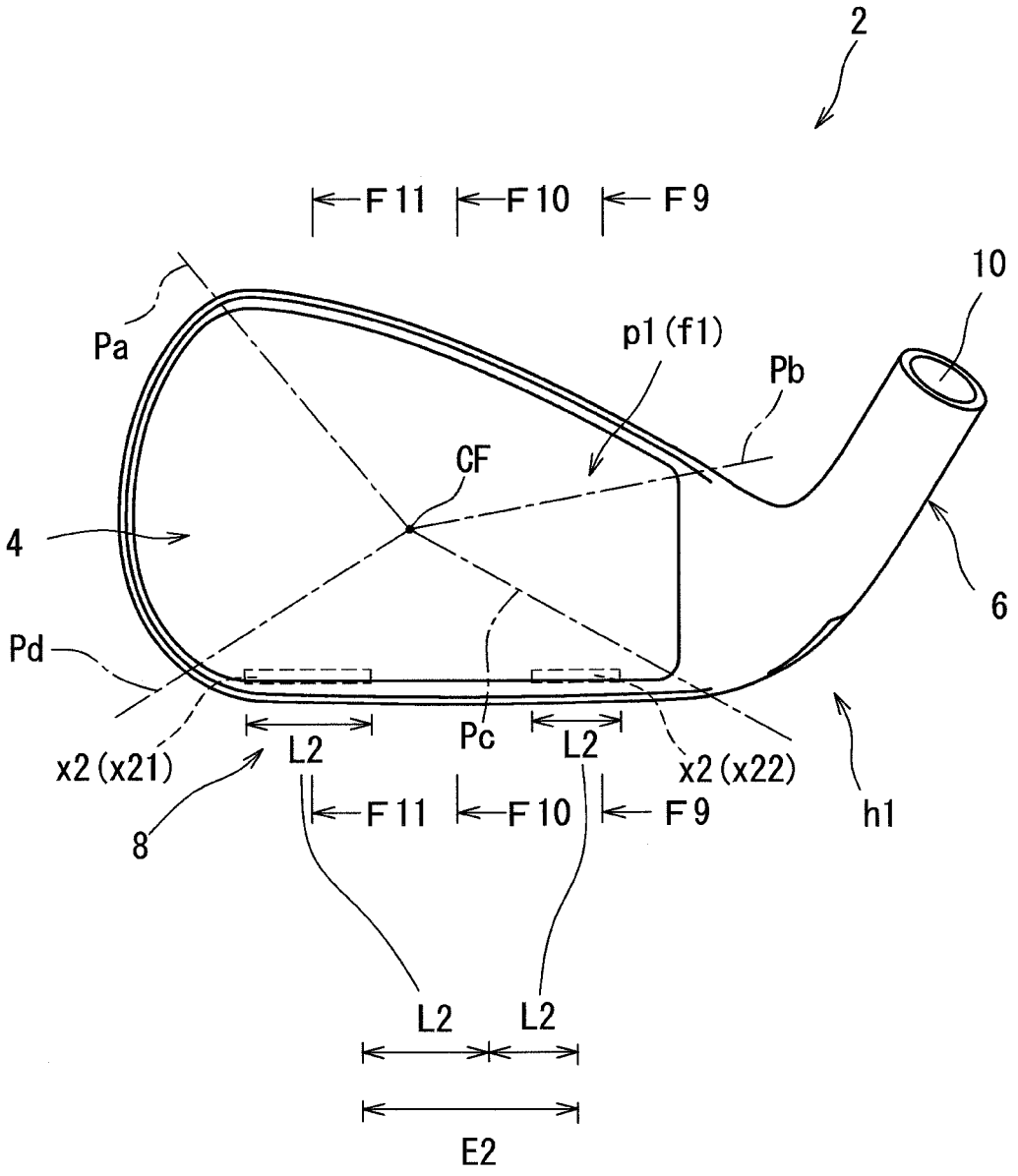
FIG. 3 is a front view of the head of FIG. 1.
Figure 4:
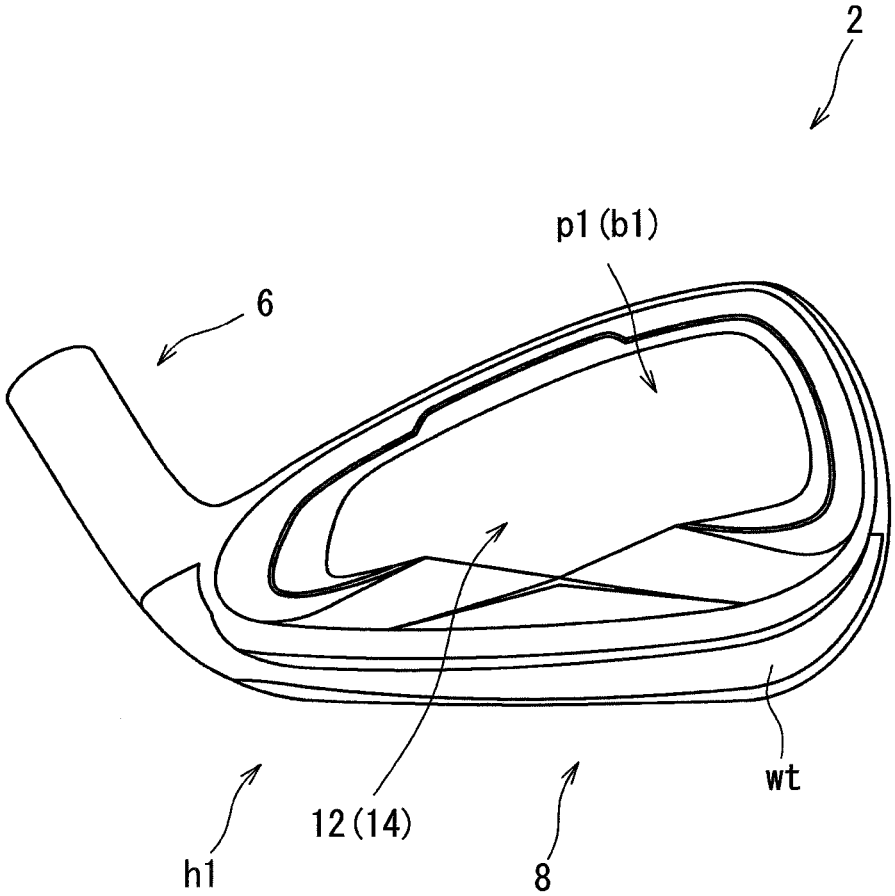
FIG. 4 is a back view of the head of FIG. 1.

FIG. 1 is a perspective view of a golf club head 2 according to a first embodiment of the present invention when the golf club head 2 is seen from an obliquely front side. FIG. 2 is a perspective view of the head 2 when the head 2 is seen from an obliquely back side. FIG. 3 is a front view of the head 2. FIG. 3 is a front view of the hitting face. FIG. 4 is a back view of the head 2.

The head 2 includes a face 4, a hosel 6, and a sole 8. The hosel 6 has a hosel hole 10. The face 4 is the hitting face. Although a face groove is formed in the surface of the face 4, the description of the face groove is omitted. A weight member wt is disposed in the sole 8. The head 2 is an iron type golf club head.

A back cavity 12 is provided on a side opposite to the face 4. The head 2 is a cavity back iron.

The head 2 includes a head body h1 and a face plate p1 fixed to head body h1. The head body h1 is made of a metal. In the present embodiment, the head body h1 is made of stainless steel. The face plate p1 is made of a metal. In the present embodiment, the face plate p1 is made of a titanium-based metal. The titanium-based metal means pure titanium or a titanium alloy. The materials of the head body h1 and face plate p1 are not limited.

The titanium alloy is an alloy containing 50% by weight or greater of titanium. Examples of the titanium alloy include α titanium, αβ titanium, and β titanium. Examples of the α titanium include Ti-5Al-2.5Sn and Ti-8Al-1V-1Mo. Examples of the αβ titanium include Ti-6Al-4V, Ti-6Al-2Sn-4Zr-6Mo, Ti-6Al-6V-2Sn, and Ti-4.5Al-3V-2Fe-2Mo. Examples of the β titanium include Ti-15V-3Cr-3Sn-3Al, Ti-20V-4Al-1Sn, Ti-22V-4Al, Ti-15Mo-2.7Nb-3Al-0.2Si, and Ti-16V-4Sn-3Al-3Nb. Examples of the pure titanium include industry pure titanium. Examples of the industry pure titanium include pure titanium of type 1, pure titanium of type 2, pure titanium of type 3, and pure titanium of type 4 which are prescribed by Japanese Industrial Standard.

Preferably, the specific gravity of the face plate p1 is smaller than the specific gravity of the head body h1. The face plate p1 having a smaller specific gravity contributes to the distribution of the weight of the head 2 to the circumference.

Figure 5:
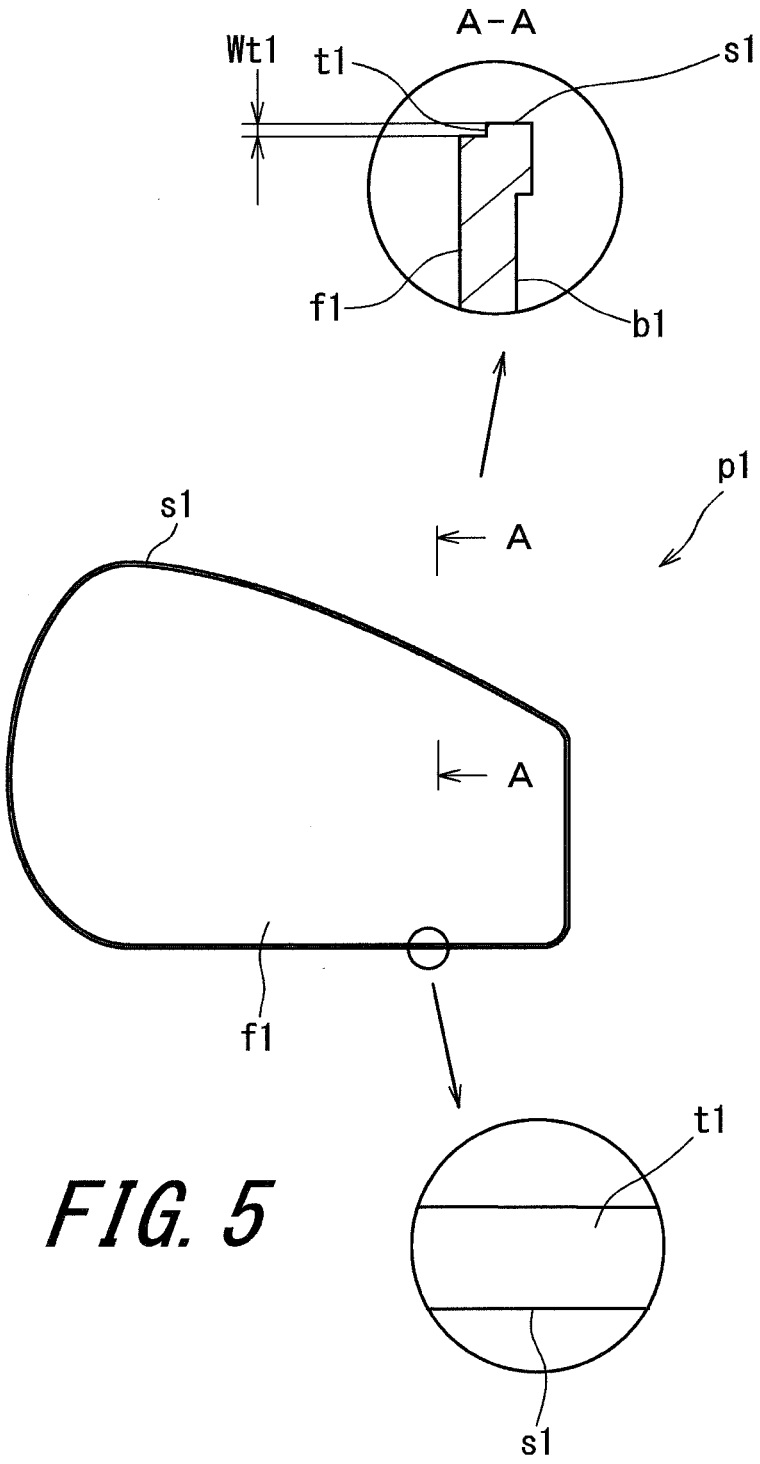
FIG. 5 is a plan view of a face plate according to the head of FIG. 1.
Figure 6:
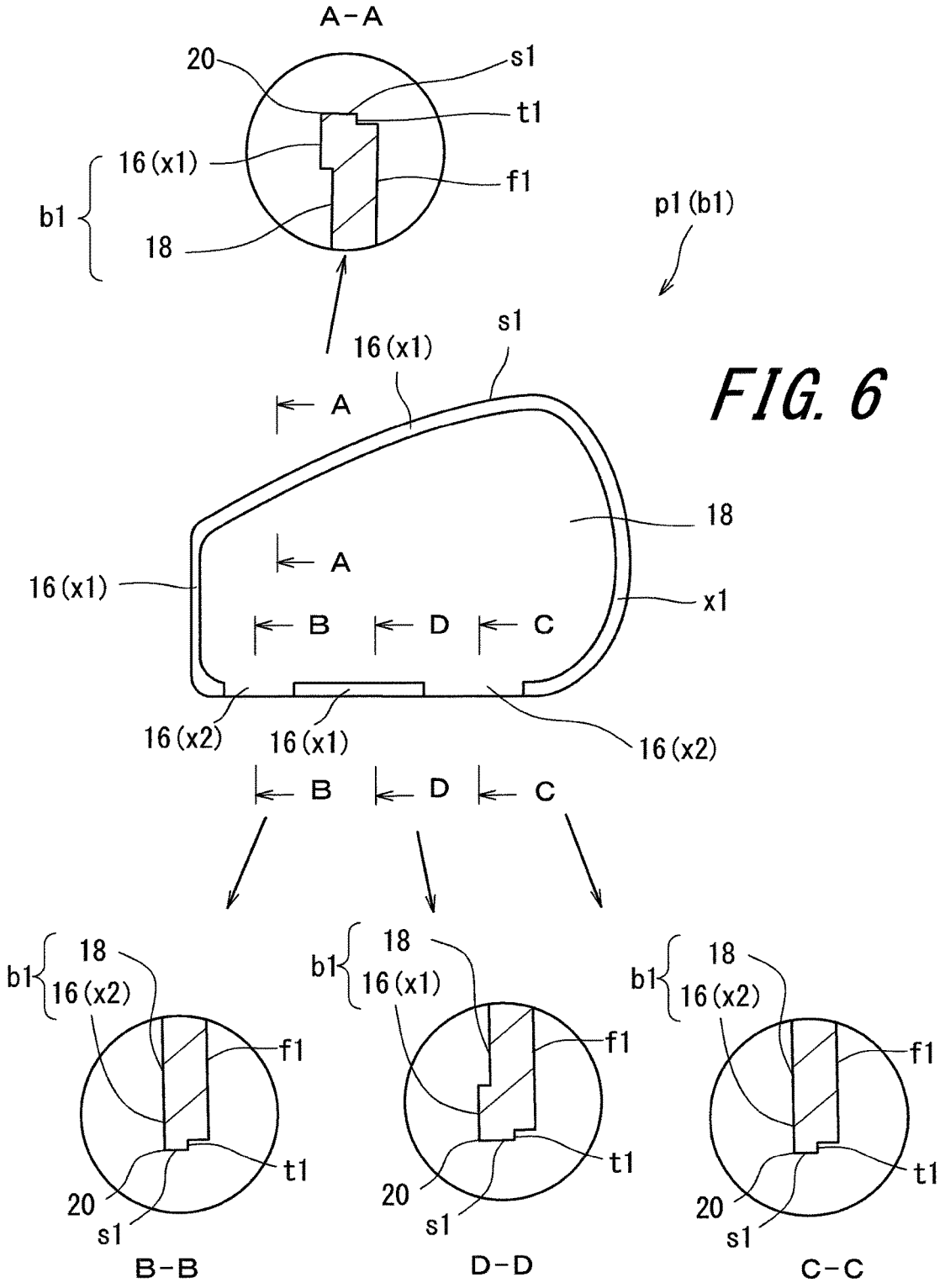
FIG. 6 is a back view of the face plate of FIG. 5.

FIG. 5 is a plan view of the face plate p1. FIG. 6 is a back view of the face plate p1. The face plate p1 includes a plate front surface f1, a plate back surface b1, and a plate side surface s1. The plate front surface f1 includes a hitting face. The hitting face is a plane except for a face groove. The plate back surface b1 is a surface opposite to the plate front surface f1. The plate side surface s1 extends between the plate front surface f1 and the plate back surface b1.

Figure 7:
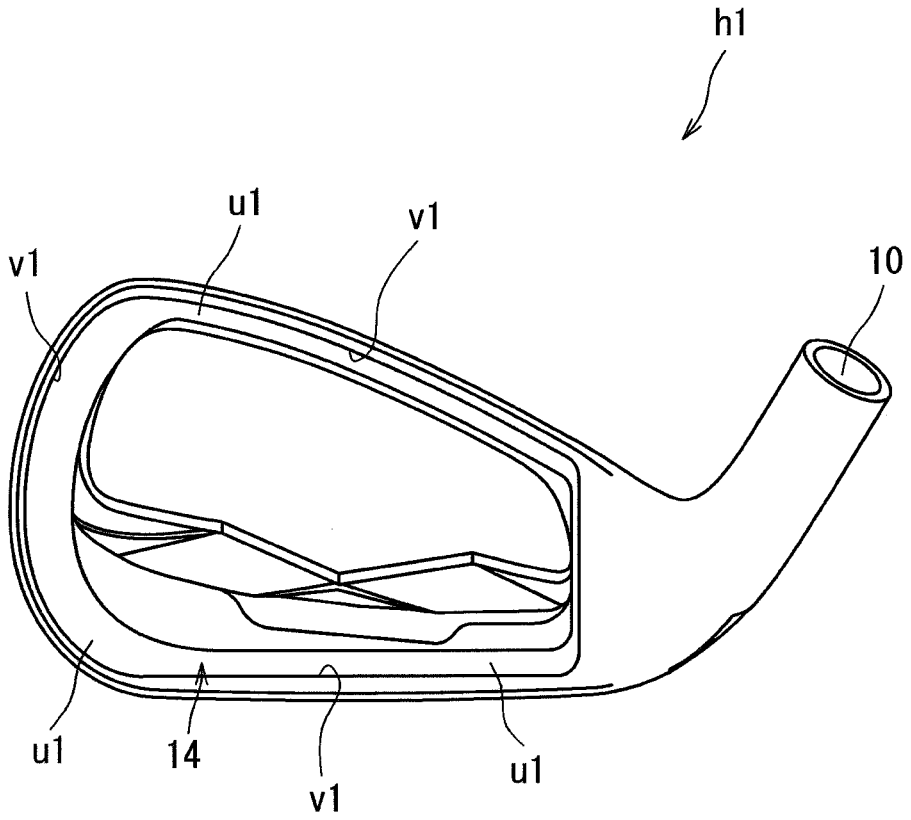
FIG. 7 is a front view of a head body according to the head of FIG. 1.

FIG. 7 is a front view of the head body h1. The head body h1 has an opening part 14. The contour of the opening part 14 is substantially equal to the contour of the face plate p1.

The head body h1 includes a receiving surface u1 which supports the plate back surface b1 of the face plate p1, and a body side surface v1 which abuts on the plate side surface s1. The whole receiving surface u1 is constituted by a single plane. The receiving surface u1 is provided over the whole circumference of the opening part 14. The body side surface v1 is provided over the whole circumference of the receiving surface u1. Apart of the plate back surface b1 is brought into contact with the receiving surface u1. In FIG. 7, the description of a plastic deforming part d1 (to be described later) is omitted.

Figure 8:
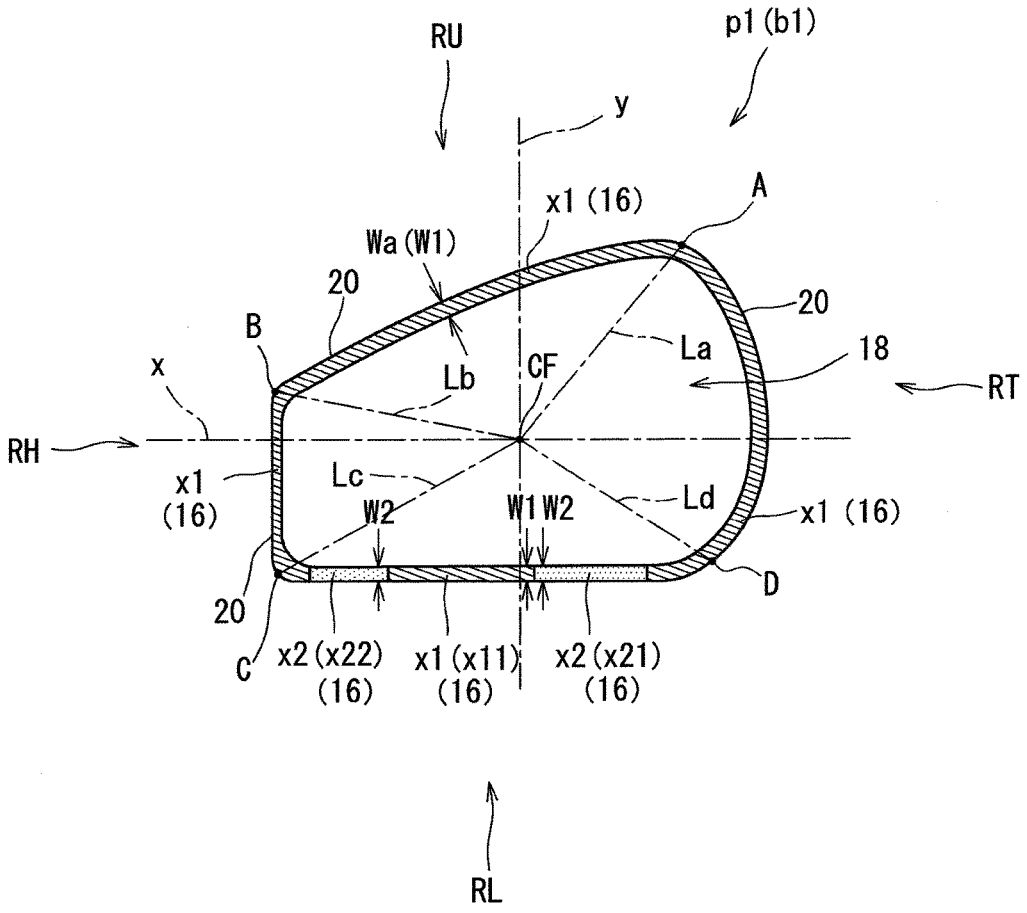
FIG. 8 is the same back view as FIG. 6, and an outer peripheral edge part is shown by hatching and a dotted pattern in FIG. 8.

FIG. 8 shows the plate back surface b1 as in FIG. 6. An outer peripheral edge part 16 is shown by hatching and a dotted pattern in FIG. 8. As shown in FIG. 8, the plate back surface b1 includes an outer peripheral edge part 16 having a circular shape, and an inner side part 18 located on the inner side of the outer peripheral edge part 16. The inner side part 18 is surrounded by the outer peripheral edge part 16.

The outer peripheral edge part 16 includes a contour line 20 of the plate back surface b1. That is, the outer contour line of the outer peripheral edge part 16 is the contour line 20. The outer peripheral edge part 16 has a width Wa. The width Wa is preferably equal to or greater than 1 mm, and more preferably equal to or greater than 1.3 mm. The width Wa is preferably equal to or less than 6 mm, and more preferably equal to or less than 5 mm.

A center of a figure of the plate back surface b1 is shown by symbol CF in FIG. 8. The center of a figure CF is determined based on the contour line 20 of the plate back surface b1.

The outer peripheral edge part 16 is comparted into four regions. These four regions are an upper edge part RU, a lower edge part RL, a toe edge part RT, and a heel edge part RH. The boundary lines of the four regions are determined as follows. In the plan view, a straight line x and a straight line y are defined. The straight line x is a straight line passing through the center of a figure CF and being parallel to the toe-heel direction. The straight line y is a straight line passing through the center of a figure CF and being parallel to the up-and-down direction.

As shown in FIG. 8, the contour line 20 is sectioned into four by the straight line x and the straight line y. A point having the minimum curvature radius is determined in each of these four sections. A point having the smallest curvature radius in a toe upper side section is shown by symbol A. A point having the smallest curvature radius in a heel upper side section is shown by symbol B. A point having the smallest curvature radius in a heel lower side section is shown by symbol C. A point having the smallest curvature radius in a toe lower side section is shown by symbol D. A straight line La which connects the point A and the center of a figure CF is defined as a boundary line between the toe edge part RT and the upper edge part RU. A straight line Lb which connects the point B and the center of a figure CF is defined as a boundary line between the upper edge part RU and the heel edge part RH. A straight line Lc which connects the point C and the center of a figure CF is defined as a boundary line between the heel edge part RH and the lower edge part RL. A straight line Ld which connects the point D and the center of a figure CF is defined as a boundary line between the lower edge part RL and the toe edge part RT.

The head 2 may be comparted into four by three-dimensionally enlarging the compartment. A plane Pa including the straight line La and being perpendicular to the hitting face, a plane Pb including the straight line Lb and being perpendicular to the hitting face, a plane Pc including the straight line Lc and being perpendicular to the hitting face, and a plane Pd including the straight line Ld and being perpendicular to the hitting face are defined (see FIG. 3). The head 2 is comparted into a toe side region, a heel side region, a top side region, and a sole side region by these four planes Pa, Pb, Pc, and Pd. Therefore, for example, each of the head body h1 and the face plate p1 is also comparted into the toe side region, the heel side region, the top side region, and the sole side region. Thus, the four regions (toe side region, heel side region, top side region, and sole side region) in the present application are defined. The toe side region, the heel side region, the top side region, and the sole side region are generically referred to as a four-section region.

The four-section region is applied to all the portions of the head 2. For example, the plate side surface s1 is sectioned into the toe side region, the heel side region, the top side region, and the sole side region. For example, the receiving surface u1 is sectioned into the toe side region, the heel side region, the top side region, and the sole side region. For example, the body side surface v1 is sectioned into the toe side region, the heel side region, the top side region, and the sole side region.

The outer peripheral edge part 16 includes a first portion x1 and a second portion x2. In FIG. 8, the first portion x1 is shown by hatching, and the second portion x2 is shown by a dotted pattern (dot). The width of the first portion x1 is shown by a double-pointed arrow W1 in FIG. 8. The width of the second portion x2 is shown by a double-pointed arrow W2 in FIG. 8. In the present embodiment, the width W2 of the second portion x2 is equal to a width W1 of the first portion x1 adjacent to the second portion x2.

The second portion x2 is located at front of the first portion x1. Since the first portion x1 abuts on the receiving surface u1, the second portion x2 cannot abut on the receiving surface u1. The first portion x1 is located at back with respect to the inner side part 18 (see an A-A enlarged sectional view and D-D enlarged sectional view of FIG. 6). In the present embodiment, the second portion x2 is flush with the inner side part 18. Without being limited to the constitution, the second portion x2 may be located at back of the inner side part 18.

A plate part including the first portion x1 as a back surface forms a protruded part protruded to back of the second portion x2. The plate part including the first portion x1 as a back surface forms a protruded part protruded to back of the inner side part 18. The plate thickness of the first portion x1 is greater than the plate thickness of the second portion x2. The plate thickness of the first portion x1 is greater than the plate thickness of the inner side part 18. The plate thickness of the second portion x2 may be the same as, greater than, or less than the plate thickness of the inner side part 18.

The protruded part provided on the face plate p1 can also be provided on the head body h1 side. However, when the specific gravity of the head body h1 is greater than the specific gravity of the face plate p1, the setting of the protruded part leads to an increase in a head weight. In addition, the shape of the head body h1 is more complicated than the shape of the face plate p1, which is less likely to subject the head body h1 to a process (for example, NC process). The face plate p1 has a plate shape, which is easily processed.

The first portion x1 includes the contour line 20 of the plate back surface b1. That is, the outer contour line of the first portion x1 is the contour line 20. The second portion x2 includes the contour line 20 of the plate back surface b1. That is, the outer contour line of the second portion x2 is the contour line 20.

In the present application, a peripheral length E2 of the second portion x2 and a peripheral length E1 of the outer peripheral edge part 16 are considered. The peripheral lengths E1 and E2 are determined by the length of the contour line 20. The peripheral length E1 is the length of the contour line 20 in the outer peripheral edge part 16. The peripheral length E2 is the length of the contour line 20 in the second portion x2. As described later, a ratio (E2/E1) may be set to a preferable range.

The second portion x2 is provided in the lower edge part RL. As shown in FIG. 8, the second portion x2 includes a toe disposing part x21 located on a toe side with respect to the center of a figure CF, and a heel disposing part x22 located on a heel side with respect to the center of a figure CF. The toe disposing part x21 is provided in the lower edge part RL. The heel disposing part x22 is provided in the lower edge part RL.

The first portion x1 exists in each of the upper edge part RU, the lower edge part RL, the toe edge part RT, and the heel edge part RH. Therefore, the face plate p1 is stably supported by the receiving surface u1.

As shown in FIG. 8, the first portion x1 exists at the position in the toe-heel direction of the center of a figure CF. The first portion x1 includes a center disposing part x11 including the same position in the toe-heel direction as the center of a figure CF and located in the lower edge part RL. The heel disposing part x22 is located on the heel side of the center disposing part x11. The toe disposing part x21 is located on the toe side of the center disposing part x11.

Thus, the first portion x1 (center disposing part x11) exists at the position in the toe-heel direction of the center of a figure CF. The second portion x2 (toe disposing part x21) exists on a toe side with respect to the center of a figure CF.

The second portion x2 (heel disposing part x22) exists on a heel side with respect to center of a figure CF.

The durability of a central portion on which hit points concentrate is secured by the existence of the first portion x1 (center disposing part x11) which exists at the position in the toe-heel direction of the center of a figure CF. In addition, the second portion x2 exists on each of the toe side and the heel side, which provide an improvement in rebound performance when the hit points are deviated leftward and rightward. In the constitution, the face plate p1 is likely to be deflected on the toe side and the heel side in which the second portion x2 exists. Therefore, the rebound performance when the hit points are deviated leftward and rightward comes closer to rebound performance when the hit points are at a central portion. As a result, a variation in a flight distance caused by a variation in the hit point is suppressed. The constitution in which the second portion x2 is provided on each of the toe side and the heel side of the first portion x1 exhibits a rebound leveling effect.

As shown in the A-A section of FIG. 6, the first portion x1 constitutes the back surface of the protruded part protruded to back. The position of the first portion x1 in the front-back direction is at back of the inner side part 18.

As shown in the B-B section and C-C section of FIG. 6, the plate part including the second portion x2 as the back surface is not protruded to back. The position of the second portion x2 in the front-back direction is at front of the first portion x1.

Figure 9:
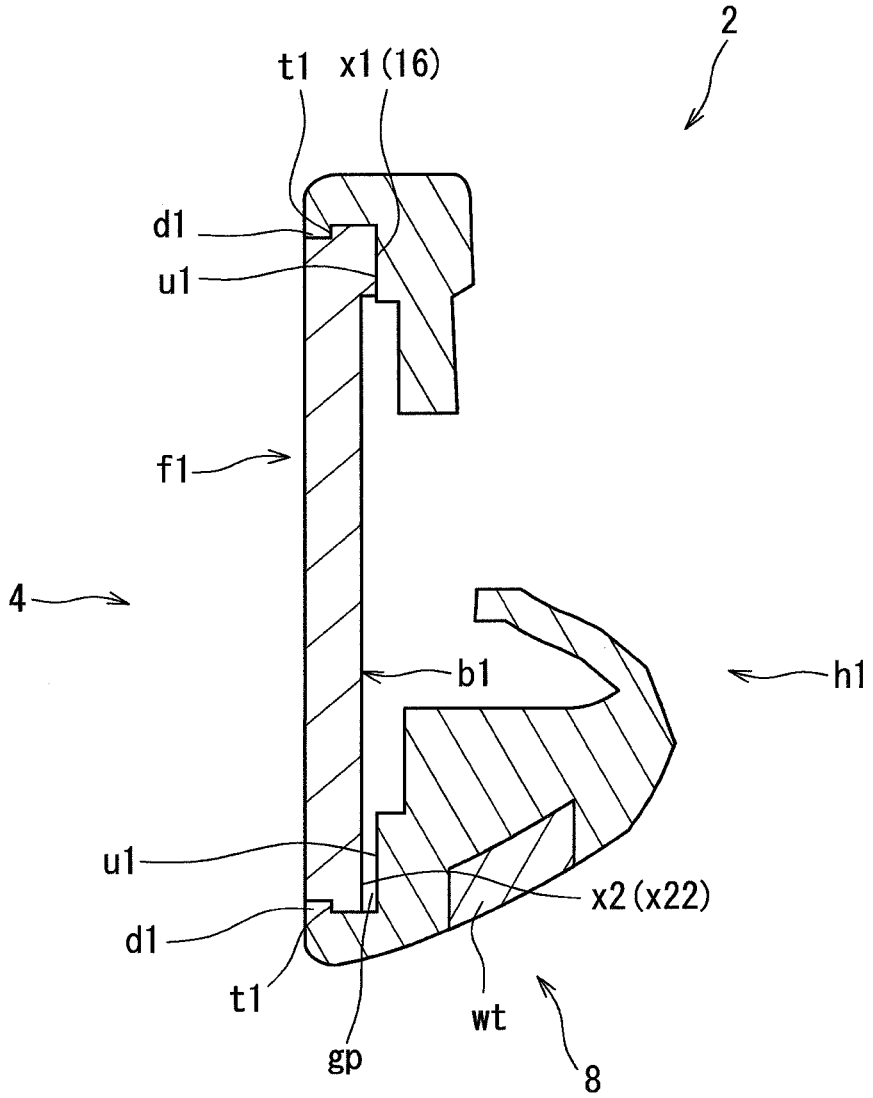
FIG. 9 is a sectional view taken along line F9-F9 of FIG. 3.
Figure 10:
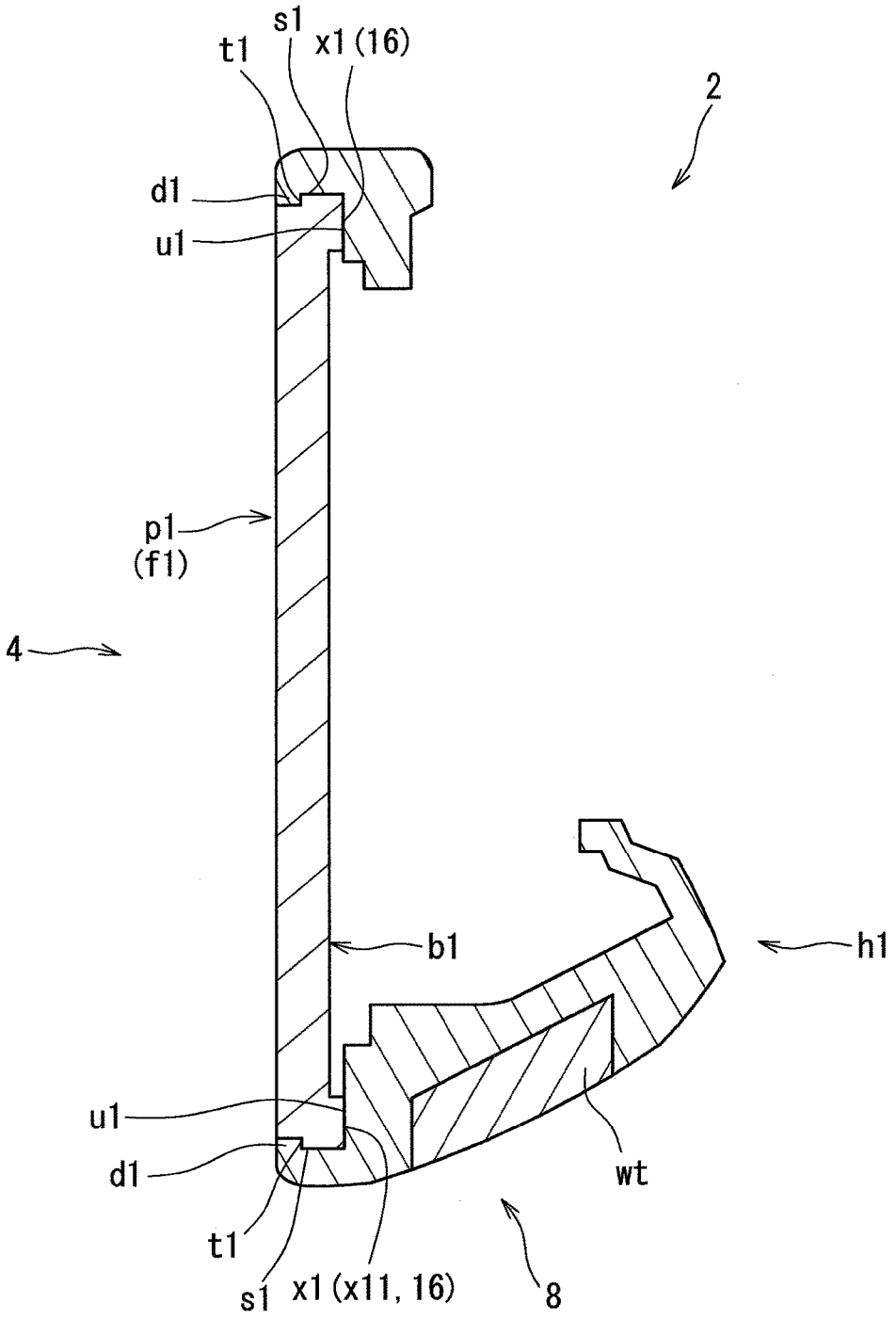
FIG. 10 is a sectional view taken along line F10-F10 of FIG. 3.
Figure 11:
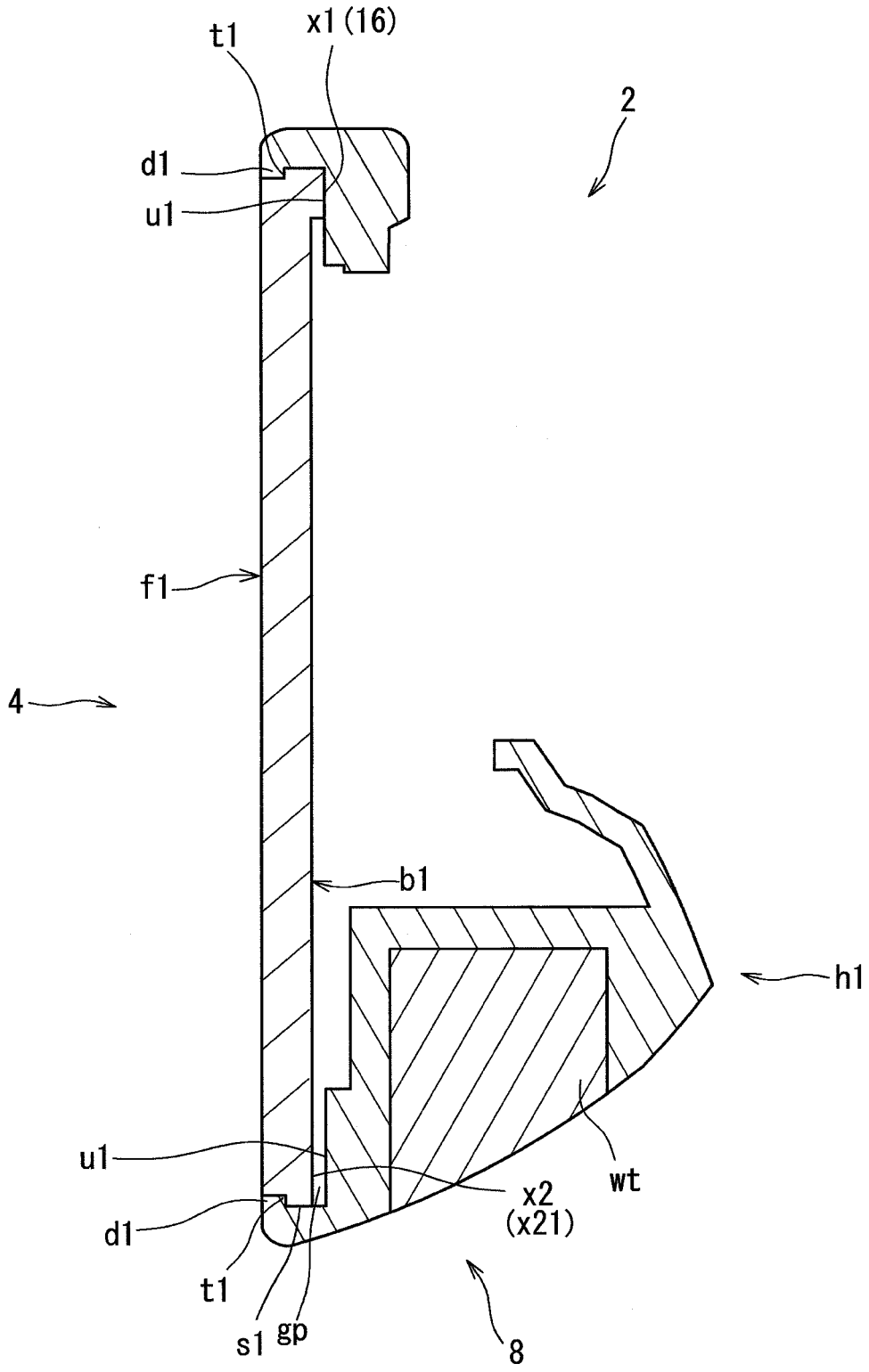
FIG. 11 is a sectional view taken along line F11-F11 of FIG. 3.

FIG. 9 is a sectional view taken along line F9-F9 of FIG. 3. The line F9-F9 gets across the second portion x22 located on the heel side. FIG. 10 is a sectional view taken along line F10-F10 of FIG. 3. FIG. 11 is a sectional view taken along line F11-F11 of FIG. 3. The line F11-F11 gets across the second portion x21 located on the toe side.

As shown in FIGS. 9, 10, and 11, the first portion x1 abuts on the receiving surface u1. Meanwhile, as shown in FIGS. 9 and 11, the second portion x2 does not abut on the receiving surface u1. The second portion x2 forms a gap gp (clearance) between the second portion x2 and the receiving surface u1. The gap gp leads to the plate side surface s1. In other words, the gap gp leads to the contour line 20 of the plate back surface b1. The gap gp forms a space. The gap gp forms a hollow part.

As shown in FIGS. 9 and 11, the second portion x2 does not abut on the receiving surface u1. For this reason, the displacement of the face plate p1 to back is not inhibited by the receiving surface u1. The constitution can promote the deflection of the face plate p1. The deflection can provide an improvement in the rebound performance of the head 2. The second portion x2 can function as a rebound promoting part (face plate deflection promoting part).

Figure 12A:
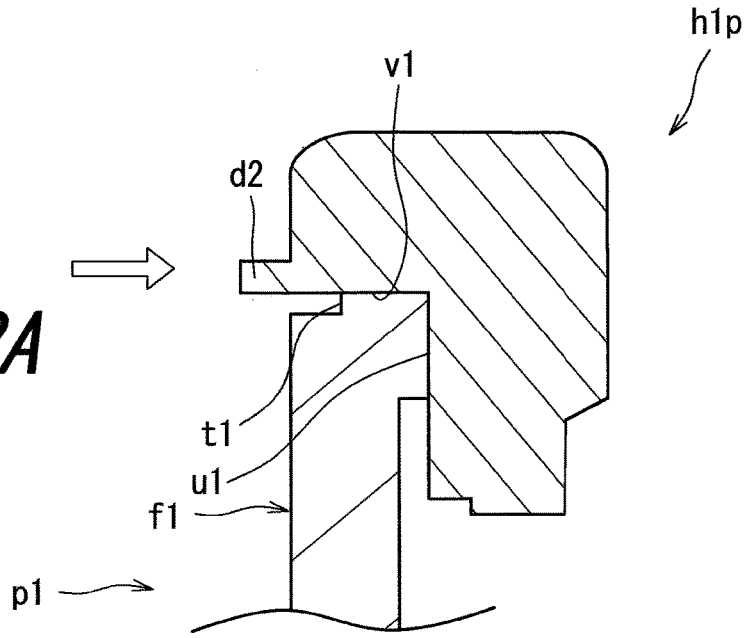
FIGS. 12A and 12B illustrate a step of forming a plastic deforming part (caulking step)
Figure 12B:
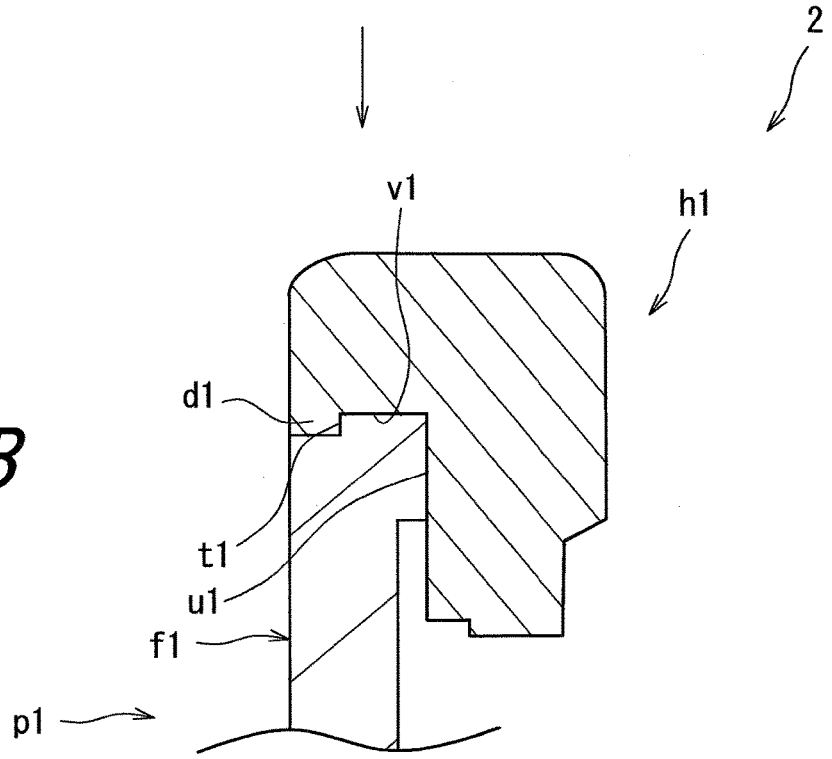

FIG. 12A and FIG. 12B show the procedure of the formation of the plastic deforming part d1.

As shown in FIGS. 9, 10, and 11, the head body h1 includes the plastic deforming part d1. The plastic deforming part d1 is located at front of the face plate p1.

As shown in FIG. 5 and FIG. 12A, a peripheral part of the plate front surface f1 includes a level difference surface t1 which is located at back with respect to the hitting face (face 4). As shown in the plan view of FIG. 5, the level difference surface t1 is provided over the whole circumference of the face plate p1. As shown in FIG. 12B, the plastic deforming part d1 covers front of the level difference surface t1. The plastic deforming part d1 entirely covers level difference surface t1 provided over the whole circumference of the plate front surface f1.

From the viewpoint of fixing the face plate p1, a width Wt1 (see FIG. 5) of the level difference surface t1 is preferably equal to or greater than 0.2 mm, and more preferably equal to or greater than 0.3 mm. In light of the formation of the plastic deforming part d1, the width Wt1 is preferably equal to or less than 2 mm, and more preferably equal to or less than 1 mm.

In a method for forming the plastic deforming part d1, first, a head body h1*p* including an undeformed projection d2 (see FIG. 12A) is prepared. The head body h1*p* is also referred to as an undeformed body. As shown in FIG. 12A, the face plate p1 is set in the undeformed body h1*p*. Next, the undeformed projection d2 is crushed by a jig having a plane parallel to the hitting face. The undeformed projection d2 and its circumference part are plastic-deformed to move to a space located at front of the level difference surface t1. As a result, at least a part of the space located at front of the level difference surface t1 is filled, which provides the formation of the plastic deforming part d1. The step is also referred to as a caulking step. The plastic deforming part d1 is also referred to as a caulked part.

Such a process method may cause a stress to remain in the plastic deforming part d1. The plastic deforming part d1 may press the level difference surface t1.

The plastic deforming part d1 physically prevents the face plate p1 from coming off to front. Furthermore, since the plastic deforming part d1 is formed by plastic deformation, the plastic deforming part d1 presses the face plate p1. The plastic deforming part d1 contributes to the fixation of the face plate p1.

In the present embodiment, the undeformed projection d2 is provided over the whole circumference of the opening part 14. The process is entirely applied to the undeformed projection d2. As a result, the plastic deforming part d1 is provided over the whole circumference of the face plate p1.

Figure 13:
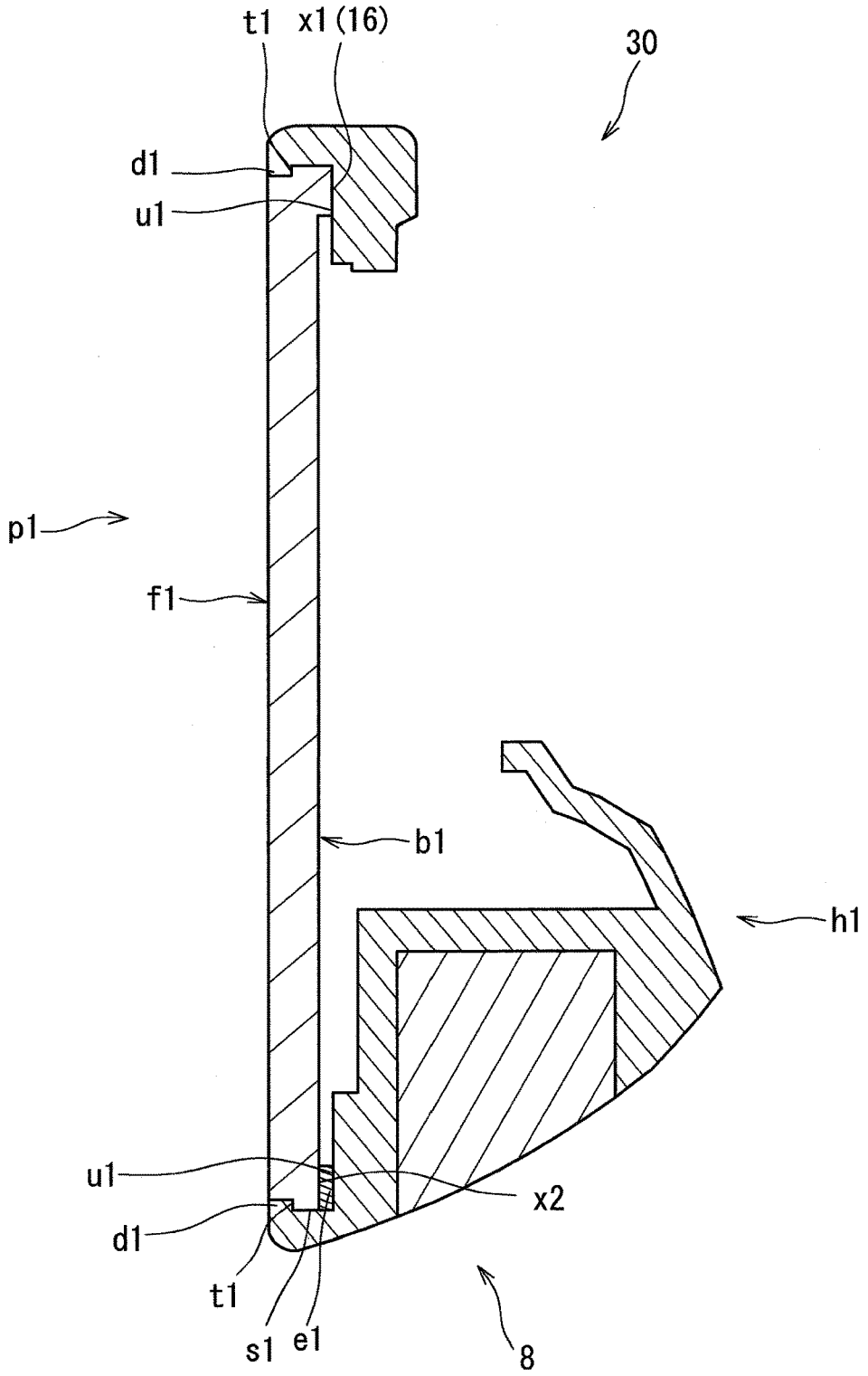
FIG. 13 is a sectional view of a head of a second embodiment.

FIG. 13 is a sectional view of a head 30 of a variation. The head 30 includes an elastic body e1. The difference between the head 2 and the head 30 is only the existence or non-existence of the elastic body e1.

As shown in FIG. 13, the elastic body e1 is provided in the gap gp formed between the second portion x2 and the receiving surface u1. In the head 30, the elastic body e1 is provided in the whole gap gp. The elastic body e1 may be provided in a part of the gap gp.

Preferably, before the face plate p1 is attached to the head body h1, the elastic body e1 is set on the face plate p1 or the head body h1. By the method, the elastic body e1 is easily disposed in the gap gp.

Preferable examples of the material of the elastic body e1 include a polymer. Examples of the polymer include an elastomer (including rubber) and a resin.

Examples of the resin include a thermosetting resin and a thermoplastic resin. Examples of the thermosetting resin include a phenol resin, an epoxy resin, a melamine resin, a urea resin, an unsaturated polyester resin, an alkyd resin, polyurethane, and thermosetting polyimide. Examples of the thermoplastic resin include polyethylene, high-density polyethylene, medium-density polyethylene, low-density polyethylene, polypropylene, polyvinyl chloride, polyvinylidene chloride, polystyrene, polyvinyl acetate, polyurethane, polytetrafluoroethylene, an ABS resin (acrylonitrile butadiene styrene resin), an AS resin, an acrylic resin, nylon, polyacetal, polycarbonate, modified polyphenylene ether, polyethylene terephthalate, polybutylene terephthalate, cyclic polyolefin, polyphenylene sulfide, polytetrafluoroethylene, polysulfone, polyether sulfone, and polyether ether ketone. Fiber reinforced resins such as a carbon fiber reinforced resin may also be used.

The Young's modulus of the elastic body e1 is preferably equal to or less than 5 GPa, more preferably equal to or less than 3 GPa, still more preferably equal to or less than 1 GPa, and yet still more preferably equal to or less than 0.5 GPa. The Young's modulus is preferably as low as 0.01 GPa or greater and 0.1 MPa or less. Examples of the material having a low elastic modulus include rubber (elastic rubber).

The elastic body e1 is likely to be deformed. The elastic body e1 is less likely to inhibit the deflection deformation of the face plate p1. The elastic body e1 contributes to an improvement in rebound performance.

The elastic body e1 has vibration characteristics according to its material. Heads having various hitting feelings can be obtained by selecting the material of the elastic body e1.

In the region of the second portion x2, the face plate p1 is not supported from back. Therefore, in the region of the second portion x2, the caulking step is less likely to be performed. The elastic body e1 supports the face plate p1 from back in the second portion x2. Therefore, the elastic body e1 facilitates the caulking step as compared with the case where the gap gp is the space.

Figure 14:
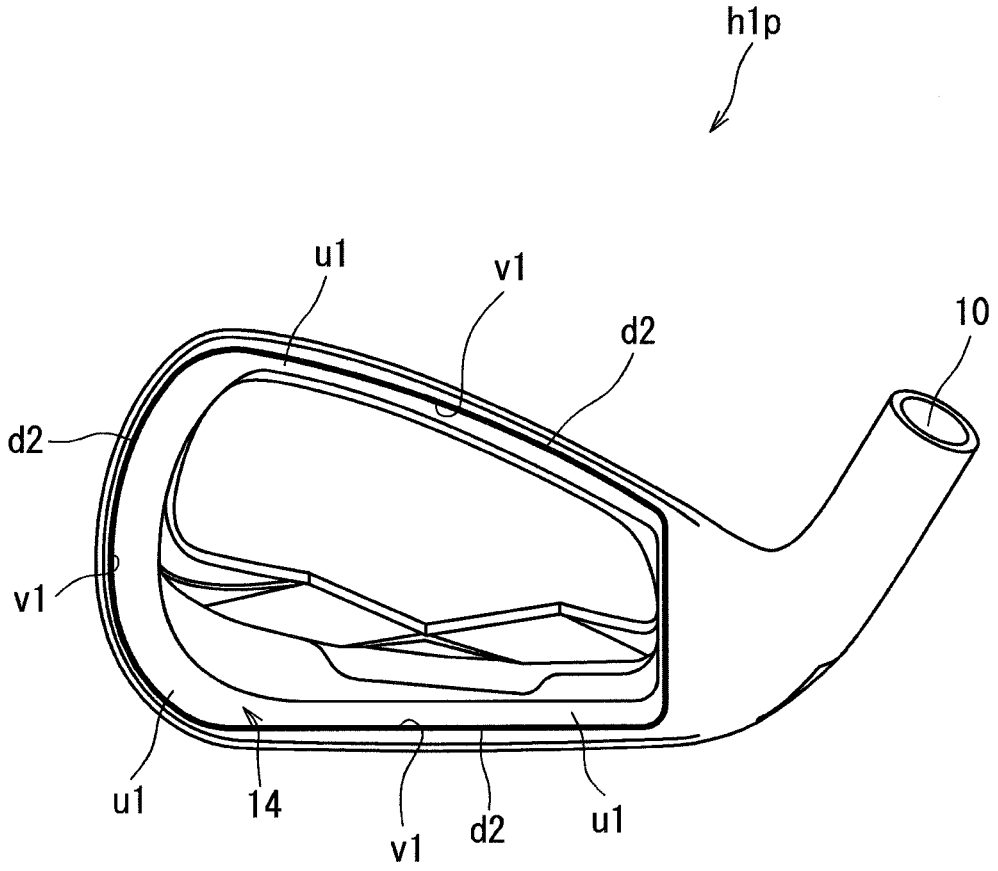
FIG. 14 is a front view of an undeformed body according to the head body of FIG. 7.

FIG. 14 is a front view of the above-mentioned head body h1*p* (undeformed body h1*p*). As described above, the head body h1*p* includes the undeformed projection d2. In FIG. 14, the undeformed projection d2 is shown by a thick line. As described above, the undeformed projection d2 is changed to the plastic deforming part d1.

As shown in FIG. 14, the undeformed projection d2 is provided over the whole circumference of the opening part 14. The undeformed projection d2 is provided along the whole body side surface v1. In the present embodiment, the face plate p1 shown in FIG. 5 is combined with the undeformed body hip. The level difference surface t1 is provided over the whole circumference of the face plate p1. The face plate p1 is set in the undeformed body h1*p*, and the undeformed projection d2 is shifted to the plastic deforming part d1 by the above-mentioned method. The whole undeformed projection d2 is shifted to the plastic deforming part d1. As a result, the plastic deforming part d1 is formed on the whole circumference of the face plate p1. In the level difference surface t1 provided on the whole circumference of the face plate p1, the plastic deforming part d1 entirely covers front of the level difference surface t1.

Thus, in the head 2, the plastic deforming part d1 is provided over the whole circumference of the face plate p1. In the head 2, the plastic deforming part d1 is provided in the region corresponding to the first portion x1, and the plastic deforming part d1 is provided also in the region corresponding to the second portion x2. In the region corresponding to the second portion x2, the face plate p1 is not supported from back. However, the caulking step can be performed also in the region corresponding to the second portion x2. This is because the face plate p1 is supported from back by the first portion x1 adjacent to the second portion x2.

The length of each of the dispersed second portion x2 is shown by a double-pointed arrow L2 in FIG. 3. When the second portion x2 is dispersed to two places of portions x21 and x22 as in the head 2, the length of each of the portions x21 and x22 is the length L2. From the viewpoint of suppressing the deformation of the face plate p1 in the caulking step, the length L2 is preferably equal to or less than 40 mm, more preferably equal to or less than 35 mm, and still more preferably equal to or less than 30 mm. From the viewpoint of rebound performance, the length L2 is preferably equal to or greater than 5 mm, more preferably equal to or greater than 10 mm, and still more preferably equal to or greater than 15 mm.

When two or more lengths L2 exist, the above-mentioned peripheral length E2 (mm) is the total of all the lengths L2. In the present embodiment, the peripheral length E2 is the total of the two lengths L2. From the viewpoint of suppressing the deformation of the face plate p1 in the caulking step, the peripheral length E2 is preferably equal to or less than 80 mm, more preferably equal to or less than 70 mm, and still more preferably equal to or less than 60 mm. From the viewpoint of rebound performance, the peripheral length E2 is preferably equal to or greater than 10 mm, more preferably equal to or greater than 20 mm, and still more preferably equal to or greater than 30 mm. The peripheral length E1 (*mm*) of the outer peripheral edge part 16 is 160 mm or greater but 280 mm or less, for example.

Figure 15:
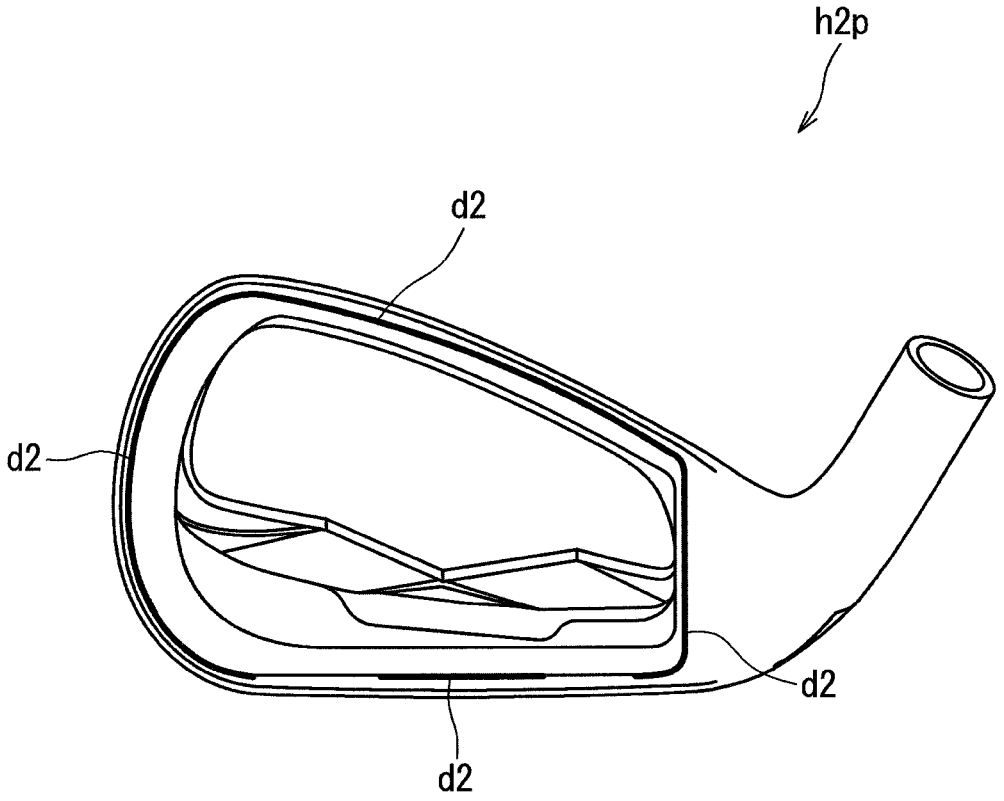
FIG. 15 is a front view of an undeformed body according to a head of a third embodiment.
Figure 16:
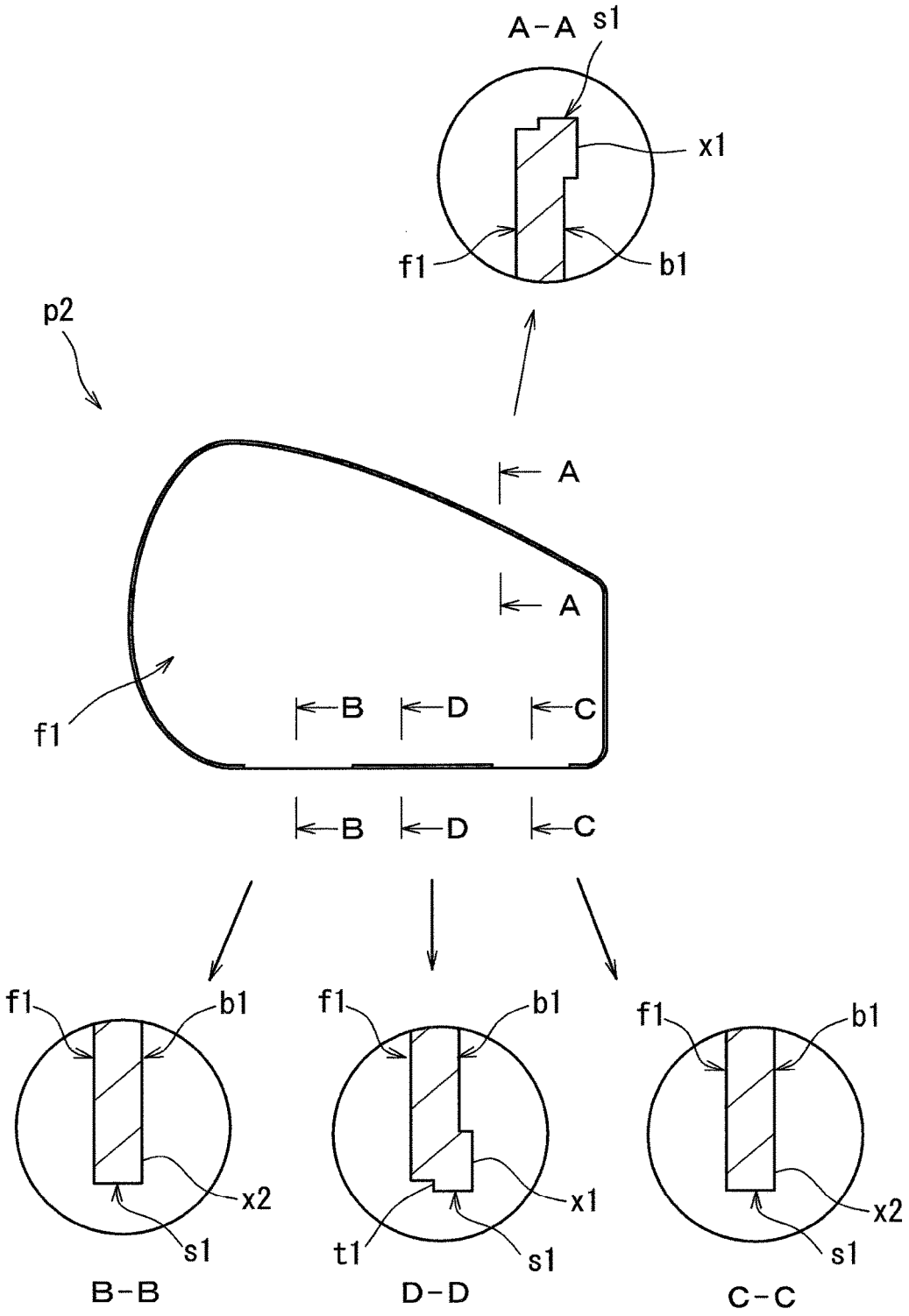
FIG. 16 is a front view of a face plate to be combined with the undeformed body of FIG. 15.

FIG. 15 shows an undeformed body h2*p* according to a head of a variation. FIG. 16 is a plan view of a face plate p2 used in combination with the undeformed body h2*p*.

As shown in FIG. 15, the undeformed body h2*p* includes an undeformed projection d2. In FIG. 15, the undeformed projection d2 is shown by a thick line. Unlike the undeformed body hip of FIG. 14, the undeformed projection d2 is not provided on the whole circumference of the undeformed body h2*p*. Except for this point, the undeformed body h2*p* is the same as the undeformed body h1*p*.

As shown in FIG. 16, the face plate p2 includes a plate front surface f1, a plate back surface b1, and a plate side surface s1. The peripheral part of the plate front surface f1 includes a level difference surface t1 which is located at back with respect to the hitting face. Unlike the face plate p1 shown in FIG. 5, the level difference surface t1 is not provided over the whole circumference of the face plate p2. Except for this point, the face plate p2 is the same as the face plate p1. Therefore, the face plate p2 includes a first portion x1 and a second portion x2 as in the face plate p1 (see FIG. 6).

In the undeformed body h2*p*, the undeformed projection d2 is provided in a region corresponding to the first portion x1. Meanwhile, the undeformed projection d2 is not provided in a region corresponding to the second portion x2. The head is produced using the undeformed body h2*p* and the above-mentioned face plate p2.

Figure 17:
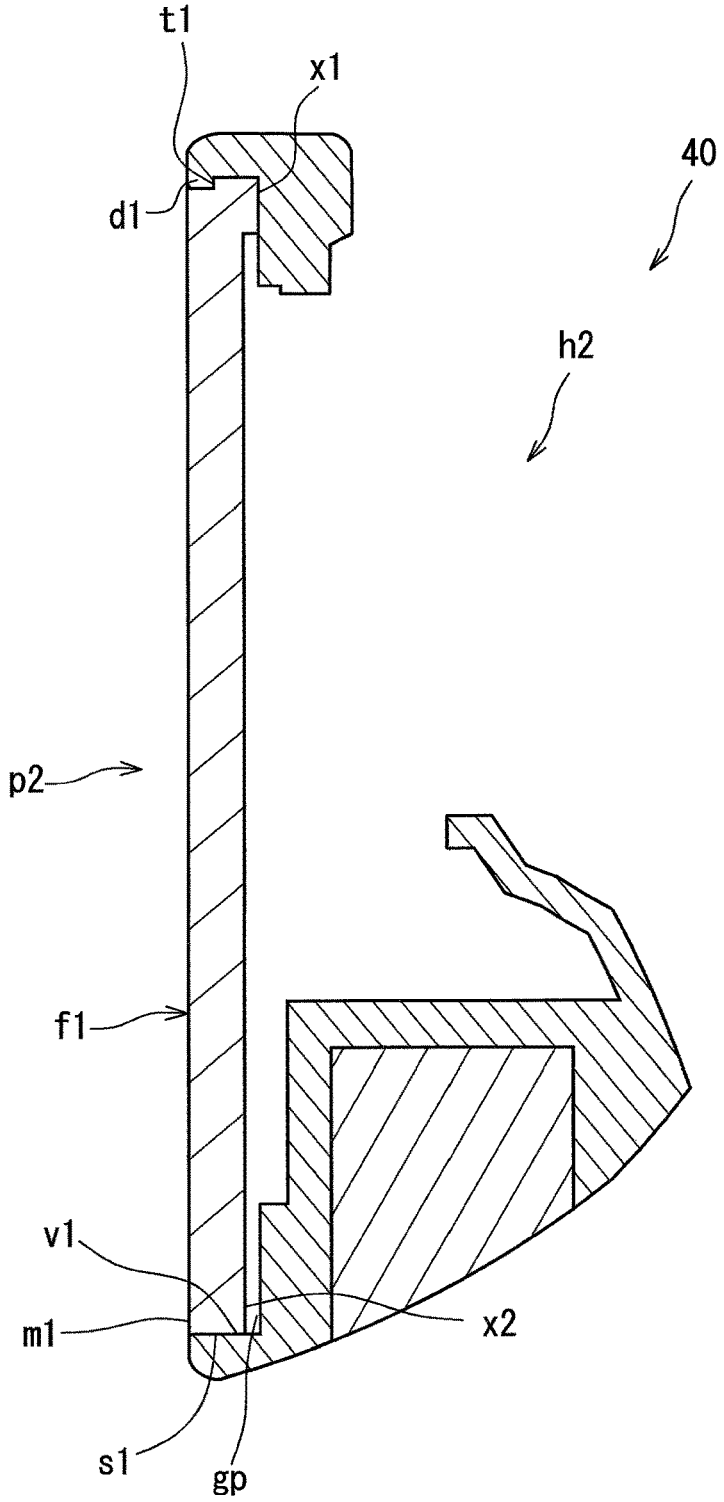
FIG. 17 is a sectional view of the third embodiment.

FIG. 17 is a sectional view of a head 40 produced using an undeformed body h2*p* and a face plate p2. In the head 40, an undeformed projection d2 of the undeformed body h2*p* becomes a plastic deforming part d1. In the head 40, the plastic deforming part d1 is provided in a region corresponding to the first portion x1, and the plastic deforming part d1 is not provided in a region corresponding to the second portion x2. In the region corresponding to the second portion x2, a head body h2 does not exist at front of the face plate p2.

"The region corresponding to the first portion x1" means a region which overlaps with the first portion x1 in planar view as shown in FIG. 8, and a region adjacent to the first portion x1 in the planar view. Similarly, "the region corresponding to the second portion x2" means a region which overlaps with the second portion x2 in planar view, and a region adjacent to the second portion x2 in the planar view.

FIG. 17 is a sectional view of the head 40 at the position of line B-B of FIG. 16. In the head 40, the peripheral part of the plate front surface f1 includes a level difference surface t1 which is located at back with respect to the hitting face, and a non-level difference surface m1 which is an extended surface of the hitting face. The head body h2 includes the plastic deforming part d1 which covers front of the level difference surface t1. The non-level difference surface ml extends to the plate side surface s1. The non-level difference surface ml reaches the body side surface v1.

Thus, in the head 40, the plastic deforming part d1 is provided in the region corresponding to the first portion x1, and a non-level difference surface ml is provided in the region corresponding to the second portion x2.

Due to the existence of the non-level difference surface ml, in the head 40, a clearance (groove-like part g1 to be described later) between the plate side surface s1 and the body side surface v1 is not formed also in a region in which the plastic deforming part d1 does not exist. Therefore, the insertion of foreign matters such as sand and grass is prevented.

The face plate p2 is deflected in hitting. The deflection can improve rebound performance. In the head 40, the plastic deforming part d1 does not exist in the region corresponding to the second portion x2. Therefore, in the region corresponding to the second portion x2, the displacement of the face plate p2 to front is not inhibited by the plastic deforming part d1. The constitution in which the plastic deforming part d1 does not exist at front of the peripheral part of the plate front surface f1 contributes to an improvement in rebound performance.

In addition, the second portion x2 does not abut on the receiving surface u1. For this reason, the displacement of the face plate p2 to back is not inhibited by the receiving surface u1. The constitution can promote the deflection of the face plate p2. Due to the deflection, the rebound performance of the head 40 can be improved. The second portion x2 may function as a rebound promoting part.

Figure 18A:
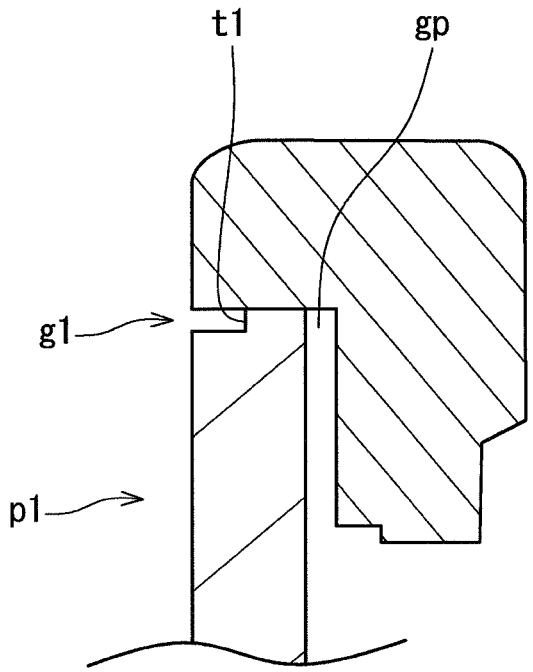
FIGS. 18A and 18B illustrate a step of disposing a resin member in a groove-like part including a level difference surface as a bottom face.
Figure 18B:
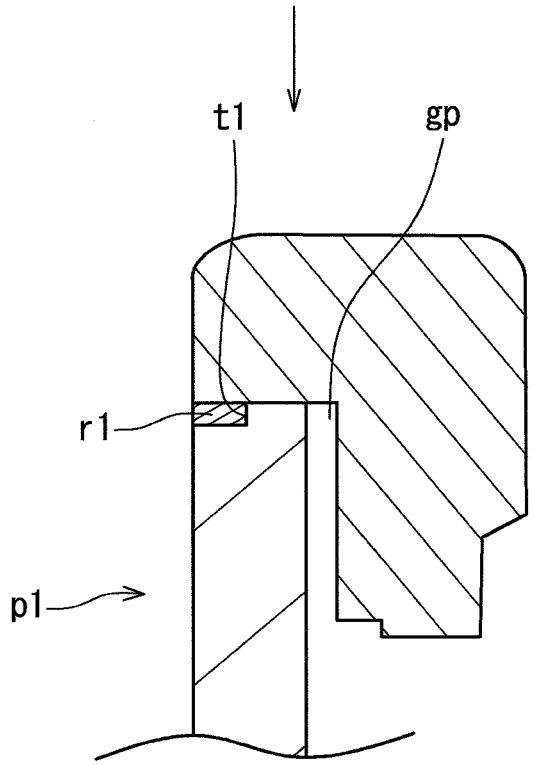

FIG. 18A is a sectional view showing a groove-like part g1 including the level difference surface t1 as a bottom face. The level difference surface t1 is formed in the face plate p1, and the plastic deforming part d1 may not be formed in the region corresponding to the level difference surface t1. In this case, as shown in FIG. 18A, the groove-like part g1 including the level difference surface t1 as a bottom face may be formed. As shown in FIG. 18B, the groove-like part g1 may be filled with a resin member r1. The resin member r1 prevents foreign matters such as sand and grass from being inserted into the groove-like part g1.

The resin member r1 may be previously molded, and disposed. The resin member r1 may be disposed by a method including filling the groove-like part g1 with a resin by means such as application or injection and thereafter curing the resin.

Examples of the resin of the resin member r1 include a thermosetting resin and a thermoplastic resin. Examples of the thermosetting resin include a phenol resin, an epoxy resin, a melamine resin, a urea resin, an unsaturated polyester resin, an alkyd resin, polyurethane, and thermosetting polyimide. Examples of the thermoplastic resin include polyethylene, high-density polyethylene, medium-density polyethylene, low-density polyethylene, polypropylene, polyvinyl chloride, polyvinylidene chloride, polystyrene, polyvinyl acetate, polyurethane, polytetrafluoroethylene, an ABS resin (acrylonitrile butadiene styrene resin), an AS resin, an acrylic resin, nylon, polyacetal, polycarbonate, modified polyphenylene ether, polyethylene terephthalate, polybutylene terephthalate, cyclic polyolefin, polyphenylene sulfide, polytetrafluoroethylene, polysulfone, polyether sulfone, and polyether ether ketone. Fiber reinforced resins such as a carbon fiber reinforced resin may also be used. From the viewpoint of the difficulty of coming off by hitting, the thermosetting resin is preferable.

Figure 19:
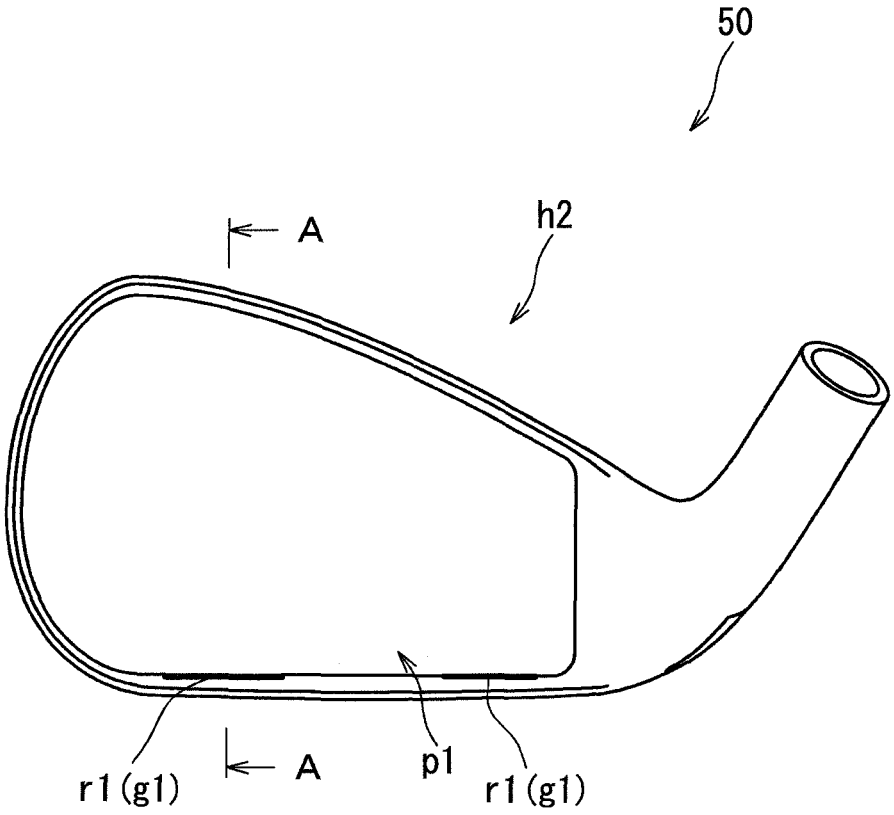
FIG. 19 is a front view of a head of a fourth embodiment, and a resin member is disposed in groove-like part including a level difference surface as a bottom face in the head.
Figure 20:
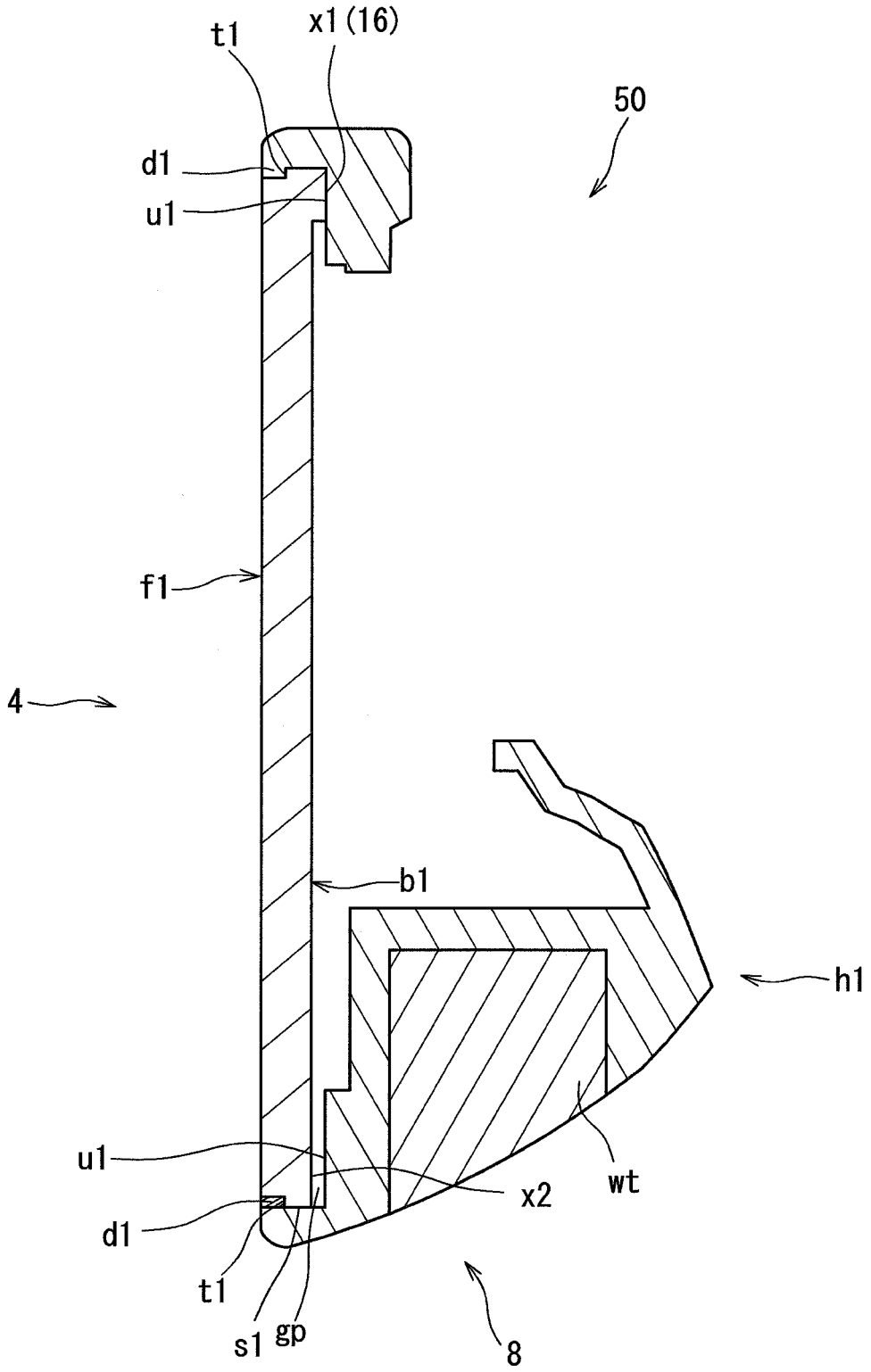
FIG. 20 is a sectional view taken along line A-A of FIG. 19.

FIG. 19 is a front view of a head 50 obtained by combining the face plate p1 (FIG. 5) with the undeformed body h2*p* (FIG. 15). FIG. 20 is a sectional view taken along line A-A of FIG. 19. As described above, the level difference surface t1 is provided on the whole circumference of the face plate p1. Meanwhile, the undeformed projection d2 is not provided on the whole circumference of the undeformed body h2*p*. In the head 50 obtained by combining these, the plastic deforming part d1 is not formed in a portion in which the undeformed projection d2 does not exist. The level difference surface t1 exists also in a portion in which the plastic deforming part d1 does not exist. As a result, the groove-like part g1 including the level difference surface t1 as a bottom face is formed in the portion in which the plastic deforming part d1 does not exist. In the head 50, the groove-like part g1 is filled with the resin member r1. In FIG. 19, the resin member r1 is shown by a thick line. The resin member r1 prevents foreign matters such as sand and grass from being inserted into the groove-like part g1. The resin member r1 is located in the sole side region of the above-mentioned four-section region. Since the sole side region is close to a sole, the foreign matters such as sand and grass are particularly apt to be inserted into the sole side region. The resin member r1 of the sole side region can effectively prevent the foreign matters from being inserted.

Figure 21:
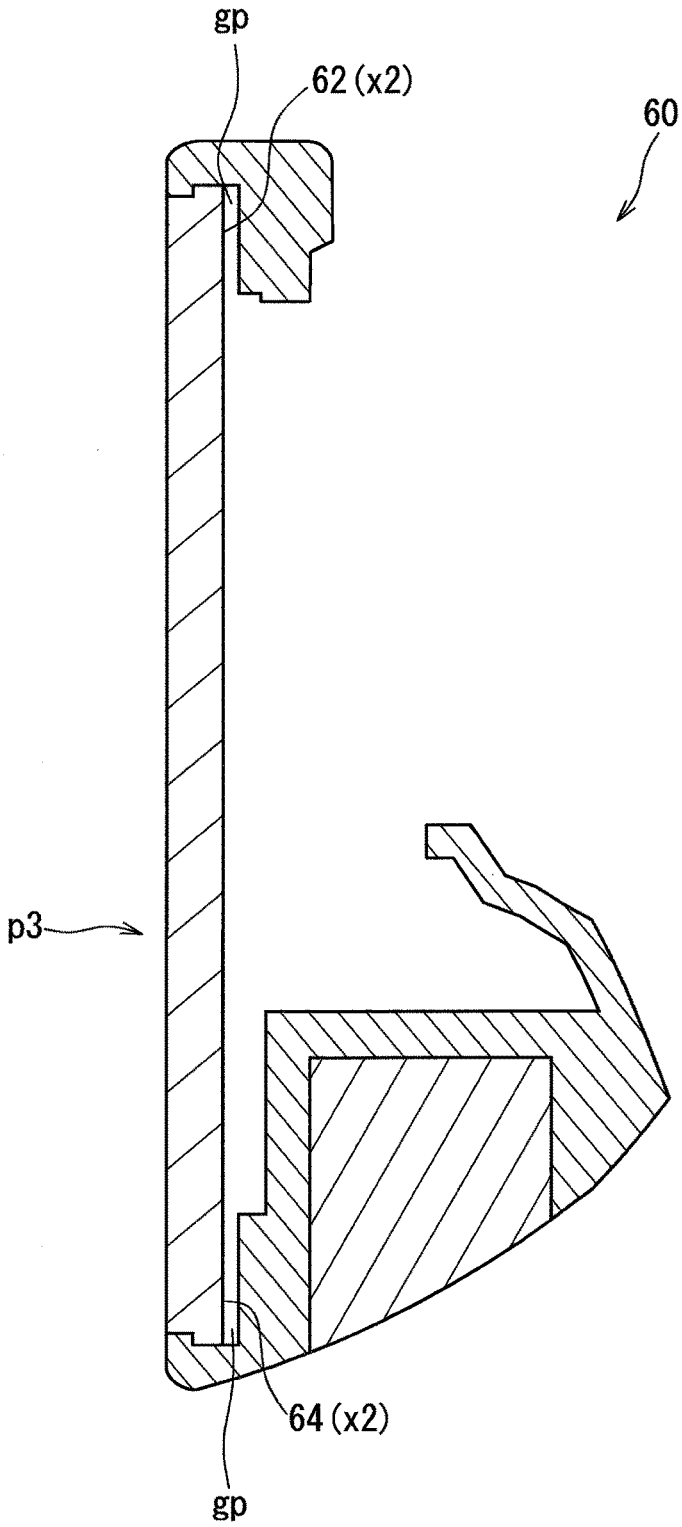
FIG. 21 is a sectional view of a head of a fifth embodiment.

FIG. 21 is a sectional view of a head 60 according to a variation. This face plate p3 includes a first portion x1 and a second portion x2, and the second portion x2 includes an upper portion 62 located in an upper edge part RU and a lower portion 64 located in a lower edge part RL. In an embodiment of FIG. 21, the toe-heel direction range of the upper portion 62 and the toe-heel direction range of the lower portion 64 overlap each other in an overlapping part. FIG. 21 is a sectional view of the overlapping part. Since both the upper edge part RU and lower edge part RL of the face plate p3 are separated from a receiving surface u1, the face plate p3 is likely to be deflected in the overlapping part. The constitution contributes to an improvement in a coefficient of restitution.

As other embodiment, a head 70 (not shown) having the following constitution is also possible. The constitution also contributes to an improvement in a coefficient of restitution.

[Constitution of Head 70]

A face plate of the head 70 includes a first portion x1 and a second portion x2. The second portion x2 includes a toe portion located in a toe edge part RT, and a heel portion located in a heel edge part RH. The head 70 includes an overlapping part in which the up-and-down direction range of the toe portion and the up-and-down direction range of the heel portion overlap each other.

As described above, in the outer peripheral edge part 16, the second portion x2 may be dispersed to two or more places.

The second portion x2 may be dispersed to two places, three places, or four or more places. Examples of the specification of dispersion include the following constitutions. Two or more selected from these constitutions may be combined.

(1) The second portion x2 is dispersed to the toe side of the center of a figure CF and the heel side of the center of a figure CF.

(2) The second portion x2 is dispersed to the upper side of the center of a figure CF and the lower side of the center of a figure CF.

(3) The second portion x2 is dispersed to the upper edge part RU and the lower edge part RL.

(4) The second portion x2 is dispersed to the toe edge part RT and the heel edge part RH.

(5) The second portion x2 is dispersed to two or more places selected from the group consisting of the upper edge part RU, the lower edge part RL, the toe edge part RT, and the heel edge part RH.

(6) The second portion x2 is dispersed to three or more places selected from the group consisting of the upper edge part RU, the lower edge part RL, the toe edge part RT, and the heel edge part RH.

(7) The second portion x2 is dispersed to the upper edge part RU, the lower edge part RL, the toe edge part RT, and the heel edge part RH.

(8) In the upper edge part RU, the second portion x2 is dispersed to the toe side of the center of a figure CF and the heel side of the center of a figure CF.

(9) In the lower edge part RL, the second portion x2 is dispersed to the toe side of the center of a figure CF and the heel side of the center of a figure CF.

(10) In the toe edge part RT, the second portion x2 is dispersed to the lower side of the center of a figure CF and the upper side of the center of a figure CF.

(11) In the heel edge part RH, the second portion x2 is dispersed to the lower side of the center of a figure CF and the upper side of the center of a figure CF.

Preferably, in the outer peripheral edge part, the whole portion excluding the second portion x2 is the first portion x1. In this case, since the first portion x1 is also secured together with the second portion x2, the face plate p1 is certainly fixed. In addition, the caulking step is facilitated by securing the first portion x1.

As described above, the peripheral length of the second portion x2 is defined as E2 (mm), and the peripheral length of the outer peripheral edge part 16 is defined as E1 (mm). From the viewpoint of rebound performance, E2/E1 is preferably equal to or greater than 0.05, more preferably equal to or greater than 0.07, and still more preferably equal to or greater than 0.1. From the viewpoint of fixing the face plate p1, E2/E1 is preferably equal to or less than 0.4, more preferably equal to or less than 0.35, and still more preferably equal to or less than 0.3.

From the viewpoint of fixing the face plate, an adhesive layer may be provided between the plate side surface s1 and the head body h1. A minute clearance between the plate side surface s1 and the body side surface v1 can be filled with the adhesive layer. The minute clearance may cause problems. For example, when water is inserted into the minute clearance, rust may occur. For example, the minute clearance may cause abnormal noise. The adhesive layer can prevent these problems.

EXAMPLES

Hereinafter, the effects of the present invention will be clarified by Examples. However, the present invention should not be interpreted in a limited way based on the description of Examples.

Example 1

The same head as the above-mentioned head 2 was produced. A face plate p1 and a head body (undeformed body) hip were prepared. The head body h1*p* was produced by casting. A weight member wt was attached to a sole part of the head body h1*p*. The weight member wt was made of a tungsten nickel alloy. The head body hip included an undeformed projection d2. The undeformed projection d2 was formed on the whole circumference of an opening part 14. The head body h1*p* was made of stainless steel (SUS630). The face plate p1 was cut from a plate material (rolling material). A first portion x1 and a second portion x2 were produced by an NC process. The face plate p1 was made of a titanium alloy. As the titanium alloy, Super-TIX (registered trademark) manufactured by Nippon Steel & Sumitomo Metal Corporation was used. The face plate p1 was fitted into the opening part 14 of the head body h1*p*. Next, by performing the above-mentioned caulking step, the undeformed projection d2 was changed to a plastic deforming part d1. Thus, a head of Example 1 was obtained. The head was a so-called number 5 iron, and a real loft angle was 24 degrees. A shaft and a grip were attached to the head to obtain a club of Example 1.

Figure 22:
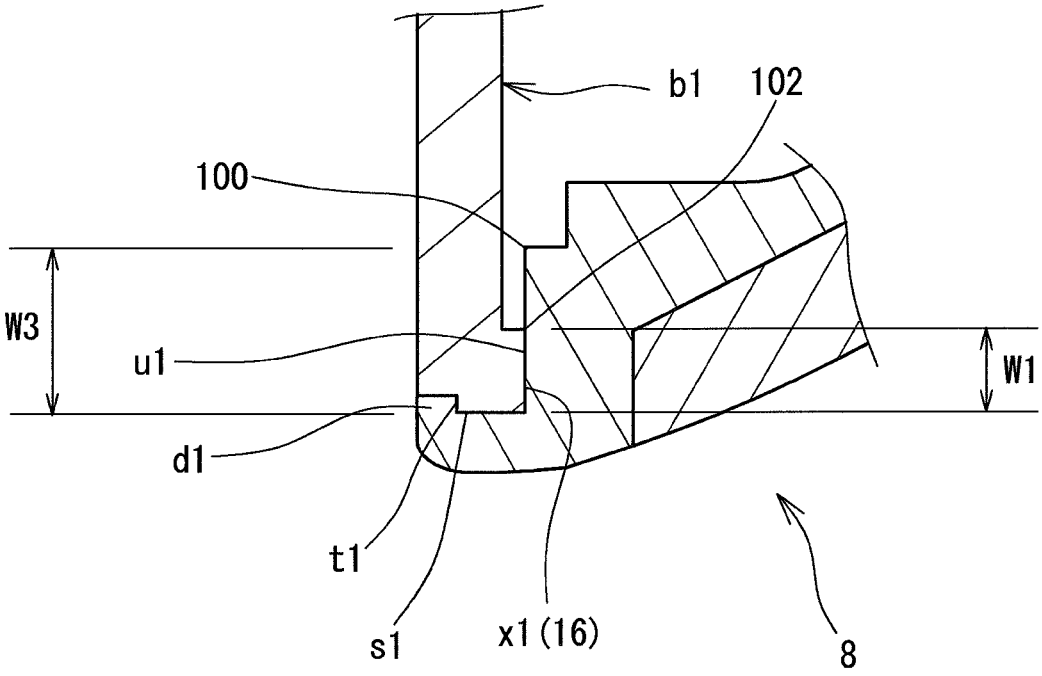
FIG. 22 is a sectional view in which a part of a head of Example 1 is enlarged.

FIG. 22 is an enlarged sectional view of the head of Example 1. A width W1 of the first portion x1 is smaller than a width W3 of a receiving surface u1. The relation of W3>W1 was realized over the whole receiving surface u1. An inner side edge 100 of the receiving surface u1 was separated from the face plate. An inner side edge 102 of the first portion x1 was brought into contact with the receiving surface u1. As described later, the constitution was found to contribute to an improvement in strength.

Example 2

A head and a club of Example 2 were obtained in the same manner as in Example 1 except that an elastic body e1 was provided between a second portion x2 and a receiving surface u1. The elastic body e1 was disposed in a whole region corresponding to the second portion x2. The elastic body e1 was pasted on a face plate p1 before being fitted into a head body h1*p*. The elastic body e1 was made of an elastomer.

Example 3

A head having the same structure as the structure of the above-mentioned head 40 was adopted. In the head, a plastic deforming part d1 was provided in a region corresponding to a first portion x1. Meanwhile, not a plastic deforming part d1 but a non-level difference surface ml was provided in a region corresponding to a second portion x2. Except for this, a head and a club of Example 3 were obtained in the same manner as in Example 1.

Comparative Example

A whole second portion x2 was replaced by a first portion x1. That is, a whole outer peripheral edge part was the first portion x1. Except for this, a head and a club of Comparative Example were obtained in the same manner as in Example 1.

The specifications and evaluation results of the heads of Examples and Comparative Example are shown in the following Table 1. The evaluation method is as follows.

[Flight Distance Test]

Twenty testers performed hitting tests. The driver head speeds of the twenty testers were 37 m/s on average. As a ball, "XXIO XD-AERO" (trade name) manufactured by Dunlop Sports Co., Ltd. was used. A value obtained by indexing the average of flight distances of ten hittings is shown in the following Table 1.

[Feeling Test]

Each of ten testers hit a ball using each club to evaluate a feeling in hitting. As the feeling, "a bouncing feeling" and "a soft hitting feeling" were evaluated. "The bouncing feeling" was evaluated on a scale of one to five. As the score is higher, the bouncing feeling is higher, and highly evaluated. "The soft hitting feeling" was evaluated on a scale of one to five. As the score is higher, the hitting feeling is softer, and highly evaluated. The average value of the evaluation points of the ten testers is shown in the following Table 1. [Table 1]

TABLE 1

Specifications and evaluation results of Examples and Comparative Example

| | Comparative Example | Example 1 | Example 2 | Example 3 |
|---|---|---|---|---|
| Real loft (degree) | 24 | 24 | 24 | 24 |
| Club length (inch) | 38 | 38 | 38 | 38 |
| Club weight (g) | 356 | 356 | 356 | 356 |
| Existence or non-existence of second portion | not exist | exist | exist | exist |
| Existence or non-existence of elastic body | not exist | not exist | exist | not exist |
| Existence or non-existence of non-level difference surface | not exist | not exist | not exist | exist |
| Flight distance (yard) | 98.9 | 100.2 | 100.0 | 100.4 |
| Bouncing feeling | 3.1 | 4.1 | 4.1 | 4.7 |
| Soft hitting feeling | 2.9 | 3.0 | 4.2 | 3.2 |

As described above, Examples are highly evaluated as compared with Comparative Example. From the results, the advantages of the present invention are apparent.

The description hereinabove is merely for an illustrative example, and various modifications can be made in the scope not to depart from the principles of the present invention.

The present invention can be applied to all golf club heads such as a wood type head, a utility type head, a hybrid type head, an iron type head, and a putter head.

What is claimed is:

1. A golf club head comprising:

a head body; and a face plate fixed to the head body, wherein:

the face plate includes a plate front surface having a hitting face, a plate back surface which is a surface opposite to the plate front surface, and a plate side surface along the peripheral side of the face plate;

the head body includes an opening part in which the face plate is disposed, and a receiving surface which supports a portion of the plate back surface;

the plate back surface includes an outer peripheral edge part having a shape corresponding to the outer periphery of the face plate;

the outer peripheral edge part of the plate back surface extends along a peripheral border between an outer contour line edge and an inner peripheral edge line disposed inward from the outer contour line edge, and includes one or more first portions which protrude from the plate back surface so as to abut the receiving surface of the head body, and one or more second portions which do not protrude from the plate back surface so as to abut the receiving surface thereby forming one or more gaps between the one or more second portions and the receiving surface of the head body; and the outer contour line edge continuously extends through the one or more first and second portions.

2. The golf club head according to claim 1, wherein if the outer contour line edge total length corresponding to the one or more second portions is defined as E2 and the outer contour line edge length corresponding to all of the one or more first and second portions is defined as E1, E2/E1 is 0.05 or greater and 0.4 or less.

3. The golf club head according to claim 1, wherein:

the golf club head and face plate have a heel side near a position to attach a club shaft and a toe side opposite to the heel side and far from the position to attach a shaft; and the one or more second portions of the plate back surface include a toe side section located on the face plate toe side, and a heel side section located on the face plate heel side.

4. The golf club head according to claim 1, further comprising an elastic body, wherein the elastic body is disposed in the one or more gaps between the one or more second portions of the plate back surface and the receiving surface of the head body.

5. The golf club head according to claim 1, wherein:

the face plate side surface includes a step portion that extends along the entire circumference of the face plate side surface, has first and second outer peripheral surfaces, and has a step front face extending between the first and second outer peripheral surfaces located rearward of the hitting face; and the head body includes a plastic deforming part that covers the entire step front face.

6. The golf club head according to claim 1, wherein:

the face plate side surface includes a step portion that extends along the face plate side surface, has first and second outer peripheral surfaces, and has a step front face extending between the first and second outer peripheral surfaces located rearward of the hitting face;

the head body includes a plastic deforming part that covers the step front face;

the plastic deforming part is provided in a region corresponding to the plate back surface first portion;

the plastic deforming part is not provided in a region corresponding to the plate back surface second portion; and the head body does not extend past the plate front surface.

7. The golf club head according to claim 6, wherein:

the step portion extends along the entire circumference of the face plate side surface; and a groove portion is formed in front of the step front face corresponding to the region wherein the plastic deforming part is not provided.

8. The golf club head according to claim 7, wherein the groove portion is filled with a resin member.

9. The golf club head according to claim 1, wherein:

the face plate side surface includes a step portion that extends along one or more portions of the face plate side surface, has first and second outer peripheral surfaces, and has a step front face extending between the first and second outer peripheral surfaces located rearward of the hitting face, and a level portion surface which does not include a step portion;

the head body includes a plastic deforming that covers the step front face; and the non-level difference surface extends to the plate side surface.

10. The golf club head according to claim 1, wherein an adhesive layer is provided between the plate side surface and the head body.

11. The golf club head according to claim 1, wherein a width Wa of the outer peripheral edge part of the plate back surface is equal to or greater than 1 mm but equal to or less than 6 mm.

12. The golf club head according to claim 5, wherein a width Wt1 of the step front face extending between the first and second outer peripheral surfaces is equal to or greater than 0.2 mm but equal to or less than 2 mm.

13. The golf club head according to claim 2, wherein the peripheral length E2 is equal to or greater than 10 mm but equal to or less than 80 mm.

14. The golf club head according to claim 1, wherein a width W1 of the plate back surface first portion is smaller than a width W3 of the head body receiving surface.

* * * * *